US009924271B2

(12) United States Patent
Lai et al.

(10) Patent No.: US 9,924,271 B2
(45) Date of Patent: Mar. 20, 2018

(54) FUNCTIONAL HEADWEAR

(71) Applicant: ACOUSTICSHEEP LLC, Erie, PA (US)

(72) Inventors: Wei-Shin Lai, Erie, PA (US); Jason Wolfe, Erie, PA (US); Wei-Han Lai, Erie, PA (US)

(73) Assignee: Acousticsheep LLC, Erie, PA (US)

( * ) Notice: Subject to any disclaimer, the term of this patent is extended or adjusted under 35 U.S.C. 154(b) by 0 days.

(21) Appl. No.: 14/504,959

(22) Filed: Oct. 2, 2014

(65) Prior Publication Data

US 2015/0092972 A1 Apr. 2, 2015

Related U.S. Application Data

(60) Provisional application No. 61/885,685, filed on Oct. 2, 2013.

(51) Int. Cl.
*H04R 5/033* (2006.01)
*H04R 1/10* (2006.01)

(52) U.S. Cl.
CPC ..... *H04R 5/0335* (2013.01); *H04R 1/1008* (2013.01); *H04R 1/1025* (2013.01); *H04R 1/1083* (2013.01); *H04R 2201/023* (2013.01)

(58) Field of Classification Search
CPC ..... H04R 9/02; H04R 9/06; H04R 1/1033; H04R 5/023; H04R 2201/023
See application file for complete search history.

(56) References Cited

U.S. PATENT DOCUMENTS 5,442,711 A * 8/1995 Toyama ..... G10K 15/12 381/119
5,815,579 A 9/1998 Boyden
8,992,433 B1 * 3/2015 Brady ..... A61B 5/01 600/301
2007/0012507 A1 1/2007 Lyon
2007/0177748 A1 * 8/2007 Yang ..... H04R 1/1075 381/309
2008/0144872 A1 * 6/2008 Phillips ..... H04R 5/0335 381/333
2008/0304691 A1 12/2008 Lai
2010/0203918 A1 * 8/2010 Watanabe ..... H04R 9/025 455/550.1
2012/0098484 A1 * 4/2012 Cheng ..... H01F 38/14 320/108

(Continued)

FOREIGN PATENT DOCUMENTS

WO 199518490 7/1995
WO WO 2013142379 A1 * 9/2013 ..... G06Q 50/10

OTHER PUBLICATIONS

Wikipedia, "Flexible Electronics", 8 pages, retrieved Jun. 10, 2015, http://en.wikipedia.org/wiki/Flexible_electronics.

*Primary Examiner* — Mark Fischer
(74) *Attorney, Agent, or Firm* — McNees Wallace & Nurick LLC

(57) ABSTRACT

An article of functional headwear is provided. The article of headwear including a material configured for surrounding at least a portion of an individual's head, an audio delivery device movably positioned within the material, and a microprocessor positioned within the material, the microprocessor being coupled to the audio delivery device.

38 Claims, 20 Drawing Sheets

(56) References Cited

U.S. PATENT DOCUMENTS

| | | | | |
|---|---|---|---|---|
| 2013/0279729 | A1* | 10/2013 | Richards | H04R 5/023 381/333 |
| 2014/0016788 | A1* | 1/2014 | Rass | H04R 25/70 381/23.1 |
| 2014/0070957 | A1* | 3/2014 | Longinotti-Buitoni | A61B 5/02055 340/870.01 |
| 2014/0193020 | A1* | 7/2014 | Krissman | H04R 1/1008 381/376 |
| 2015/0050972 | A1* | 2/2015 | Sarrafzadeh | G06Q 50/10 463/7 |

* cited by examiner

FUNCTIONAL HEADWEAR

CROSS-REFERENCE TO RELATED APPLICATIONS

This application claims priority to, and the benefit of, U.S. Provisional Patent Application No. 61/885,685, filed Oct. 2, 2013, entitled Functional Headwear, which is hereby incorporated by reference in its entirety.

FIELD OF THE INVENTION

The present invention is directed to functional headwear. More specifically, the present invention is directed to headwear having sensation producing devices contained therein.

BACKGROUND OF THE INVENTION

People often enjoy listening to music and other sounds while performing a variety of activities. During many of the activities it may be desirable to use a personal audio system having at least one portable speaker juxtaposed next to the ear canal. Juxtaposing the portable speaker next to the ear canal directs substantially all of the music and/or other sounds directly to the user while eliminating or substantially eliminating the sound heard by others.

There have been many different methods to juxtapose a speaker next to the ear canal. The traditional headphone ("over head") has a plastic or metal headband across the top of the head with speakers encased in plastic on either side. The cord for the traditional headphone protrudes from either both speakers or just one speaker and is worn on the front of the individual. Newer designs for headphones include a plastic band that is worn across the occipital portion of the head ("behind head"), connecting the two speakers with a wire that could be worn on the front or the back. There are also the in-ear headphones ("earbuds") with wires from both speakers that may be worn inside the ear canal. None of these common personal audio delivery systems are very comfortable when worn during sleep or exercise.

The "over head" and "behind head" headphones use a hard material like plastic or metal to hold the shape, and include bulky plastic or metal-enclosed speaker. The bulky plastic or metal enclosed speakers would be uncomfortable when lying on the side, and are unlikely to stay in place for an extended period of time with normal sleep. While the "earbuds" design does not include the hard material like plastic or metal to hold the shape, the speaker is often irritating to the soft ear cartilage. When they are worn for an extended period of time, the hard components may actually cause ulcers in the thin skin of the ears, and an inability for the ear canal to be ventilated may predispose the wearer to fungal or bacterial ear canal infections.

These common personal audio delivery systems are also uncomfortable and/or difficult to keep positioned near the ear canal during physical activity. The "over head" and "behind ear" headphones may easily fall off the users head and/or slide away from the ear canal as the user moves in different directions. Additionally, the "over head" and "behind ear" headphones which have enlarged speakers and/or speaker housings are cumbersome and add substantial weight to the headphones. The "earbuds" often become dislodged during activity and become increasingly more irritating as they are continuously repositioned in the ear.

A personal audio system that does not suffer from one or more of the above drawbacks would be desirable in the art.

SUMMARY OF THE INVENTION

In one embodiment, an article of headwear includes a material configured for surrounding at least a portion of an individual's head, an audio delivery device movably positioned within the material, and a microprocessor positioned within the material, the microprocessor being coupled to the audio delivery device.

In another embodiment, a method of generating sounds includes providing an article of headwear, the article of headwear including a material configured for surrounding at least a portion of an individual's head, an audio delivery device movably positioned within the material, and a microprocessor positioned within the material, the microprocessor being coupled to the audio delivery device; algorithmically generating sounds with the microprocessor; and playing the sounds through the audio delivery device.

In another embodiment, a method of recording activity includes providing an article of headwear, the article of headwear including a material configured for surrounding at least a portion of an individual's head, at least one sensor, and a microprocessor positioned within the material, the microprocessor being coupled to the at least one sensor; determining a wearer's activity with the at least one sensor; communicating the wearer's activity to the microprocessor; and storing the wearer's activity with the microprocessor as stored activity.

An advantage of exemplary embodiments is that an electronic device and audio delivery system may be entirely contained within an article of headwear.

Another advantage is that the electronic device and the audio delivery system may wirelessly play sound, such as music.

Yet another advantage is that the electronic device and the audio delivery system may play algorithmically generated sounds.

A further advantage is that the electronic device may algorithmically generate sounds in response to parameters received from integrated sensors, and play the algorithmically generated sounds through the audio delivery system.

Another advantage is that the electronic device may interactively generate sounds in response to a wearer's activity and/or surrounding.

A further advantage is that the electronic device may provide stimulation to a wearer. The stimulation may be configured for therapeutic purposes.

Yet another advantage is that the electronic device may include induction charging to wirelessly charge the electronic device within the article of headwear.

Other features and advantages of the present invention will be apparent from the following more detailed description, taken in conjunction with the accompanying drawings which illustrate, by way of example, the principles of the invention.

BRIEF DESCRIPTION OF THE DRAWINGS

Wherever possible, the same reference numbers will be used throughout the drawings to represent the same parts.

DETAILED DESCRIPTION OF THE INVENTION

Provided are headphones in an article of headwear and a method of affixing headphones within an article of headwear. Embodiments of the present disclosure, in comparison to processes and articles not using one or more of the features disclosed herein, provide increased wearer comfort, increase wearability, decrease external parts, increase adjustability, or a combination thereof.

While sections and headings are provided to assist the reader, the features discussed in the various sections are not limited to the individual section. Instead, the features of each section may be combined with the features of any other section, unless otherwise stated.

Article of Headwear

Figure 3:
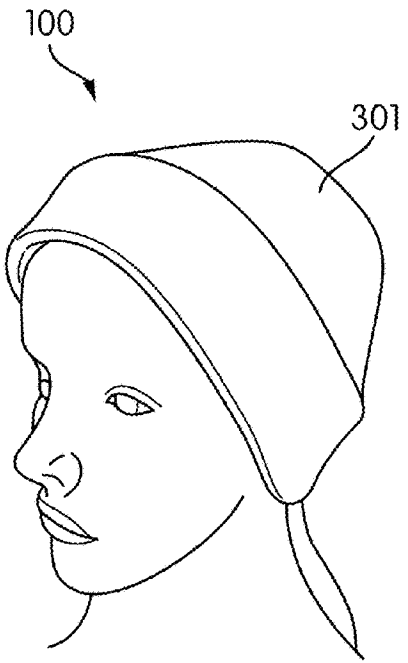
FIG. 3 shows a perspective view of a beanie according to an embodiment of the disclosure.
Figure 2:
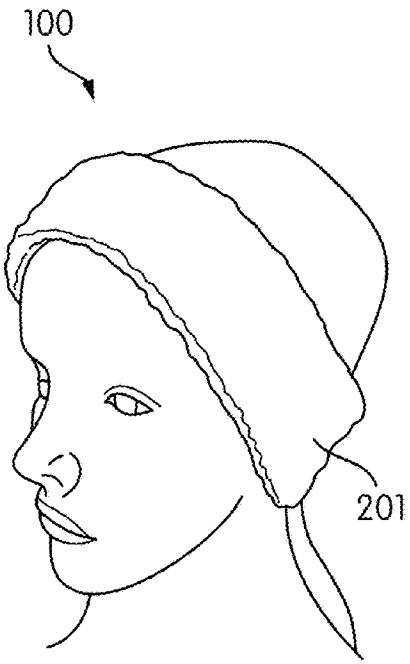
FIG. 2 shows a perspective view of a winter cap according to an embodiment of the disclosure.
Figure 1:
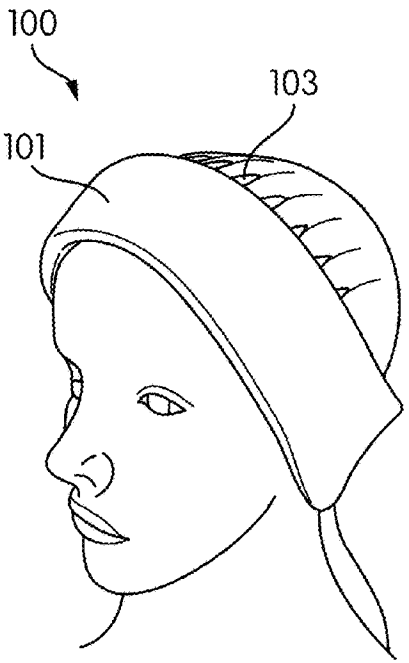
FIG. 1 shows a perspective view of a headband according to an embodiment of the disclosure.

Referring to FIGS. 1-3, an article of headwear (headwear) 100 includes any article configured to surround at least a portion of an individual's head. Suitable articles include, but are not limited to, a headband 101 (FIG. 1), a hat, a visor, a winter cap 201 (FIG. 2), a beanie 301 (FIG. 3), a kerchief, a sleep cap, a sleep kerchief, other articles of sleep attire, or other articles of active attire. The headwear 100 includes one or more suitable materials for providing comfort and/or function. Suitable materials include, but are not limited to, climate specific fabric, breathable fabric, insulative fabric, elastic material, adjustable material, cotton, wool, silk, designer patterned fabric with fashion designs, or a combination thereof.

Figure 4:
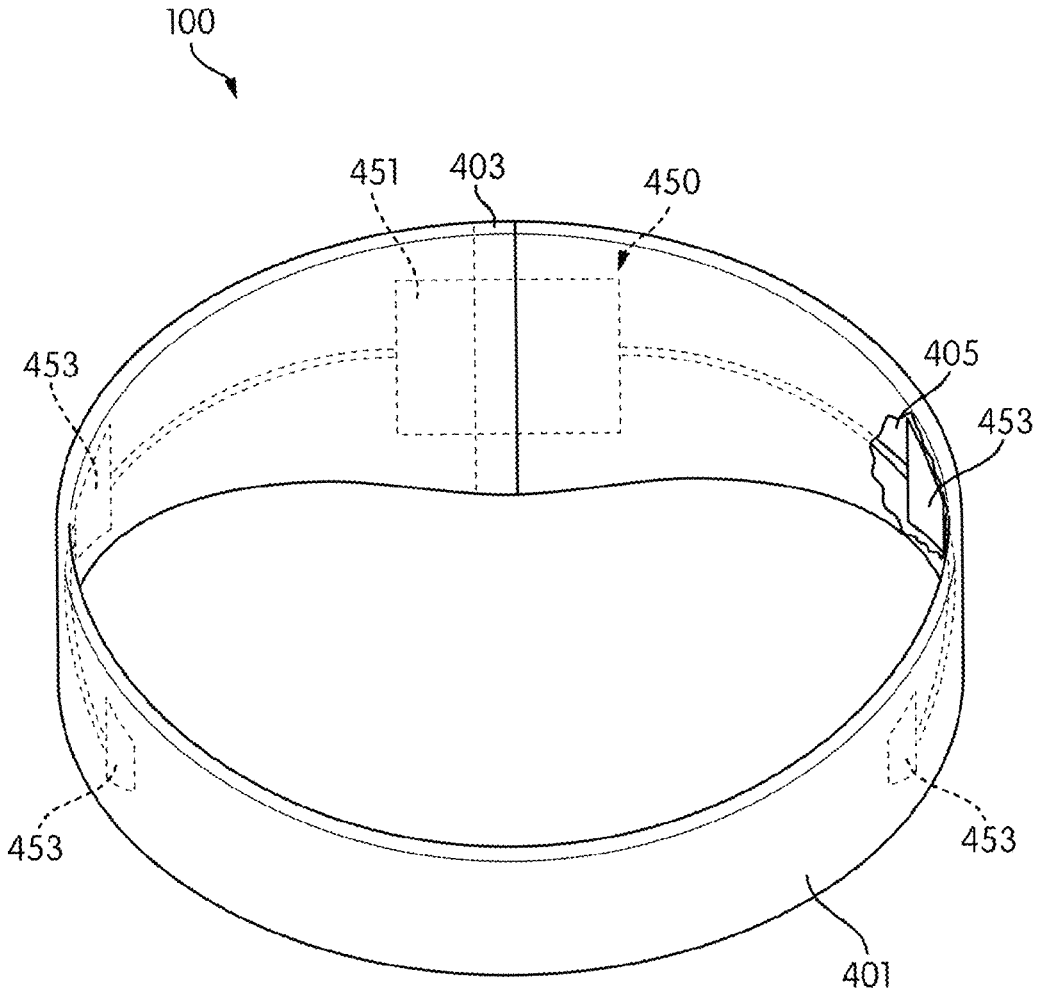
FIG. 4 shows a perspective view of an article of headwear according to an embodiment of the disclosure.
Figure 5:
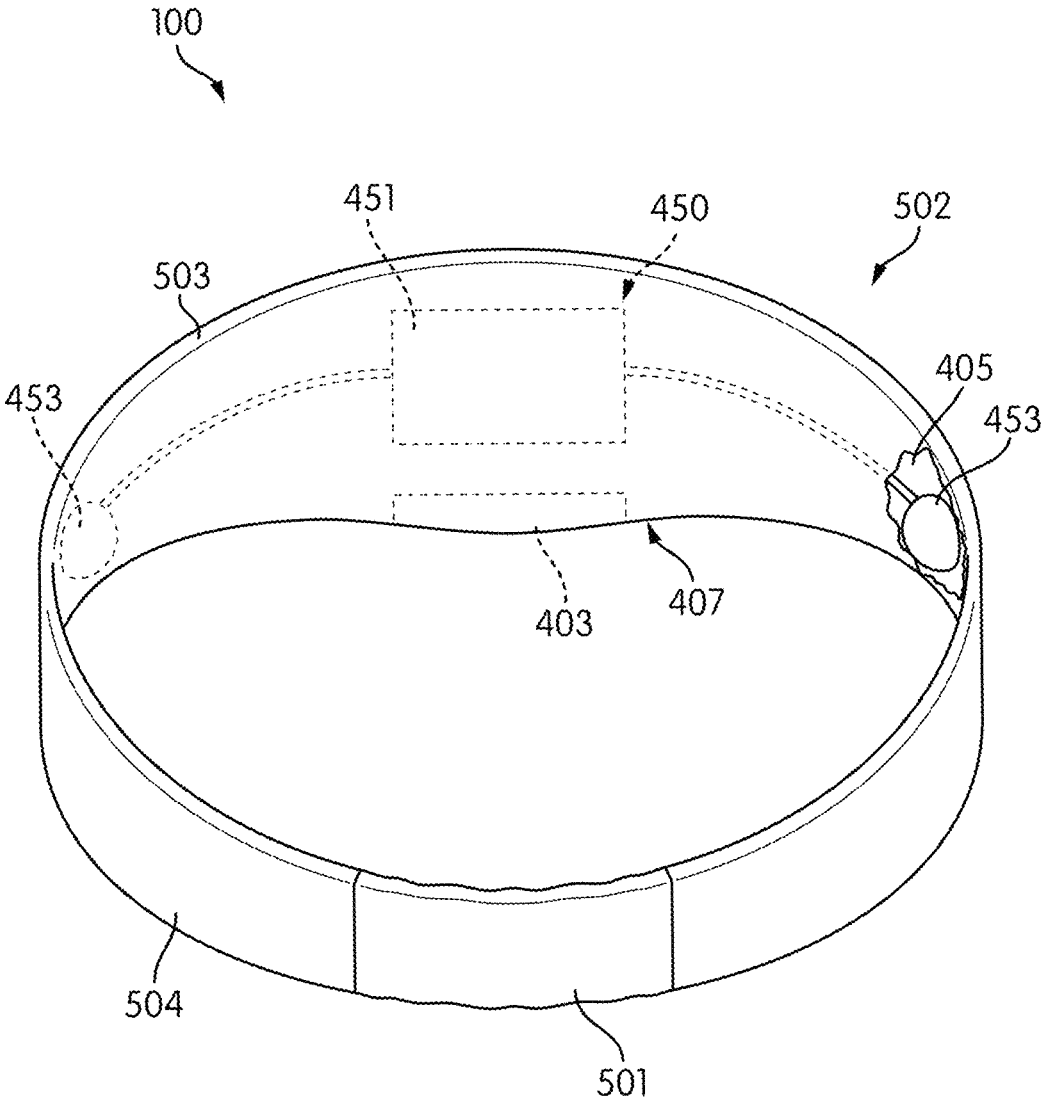
FIG. 5 shows a perspective view of an article of headwear having different section of material according to an embodiment of the disclosure.

In one embodiment, as illustrated in FIG. 4, the headwear 100 includes a single material or combination of materials 401 throughout. Alternatively, as illustrated in FIG. 5, the headwear 100 includes at least a first section 501 and a second section 502, each of the sections including one or more different materials to provide different effects. The different materials include, but are not limited to, a wicking mesh for cooling, a heat conducting fabric, fleece for softness, spandex for stretchiness, printed patterns for design, or a combination thereof. For example, the first section 501 may include the wicking mesh to provide cooling, and the second section 502 may include the fleece to provide softness. In another embodiment, the second section 502 includes an inner face 503 and an outer face 504, the inner face 503 and the outer face 504 including different materials, textures, designs, and/or patterns. In a further embodiment, the headwear 100 is reversible to provide different fashions and/or uses.

For example, the inner face 503 may include a flannel material while the outer face 504 includes a satin material. When the outer face 504 faces away from the wearer, the satin material reduces friction against adjacent surfaces, such as a pillow, permitting the wearer to turn their head during sleep without displacing the headwear 100. Alternatively, when reversed, the inner face 503 faces away from the wearer providing a different aesthetic. The headwear 100 includes any suitable decoration and/or pattern, such as, but not limited to, patches, threading that glows in the dark so the product is easily located at night, textured portions, silk-screens, logos, threading, lighting wires, or a combination thereof. In one embodiment, the decorations and/or patterns permit the wearer to orient the headwear 100 correctly in the dark. In another embodiment, insulating and/or reflecting material integrated into the headwear 100 protects the wearer's head and/or body from external electromagnetic radiation which may impact the wearer's health and/or quality, onset, and/or duration of the wearer's sleep.

Figure 6:
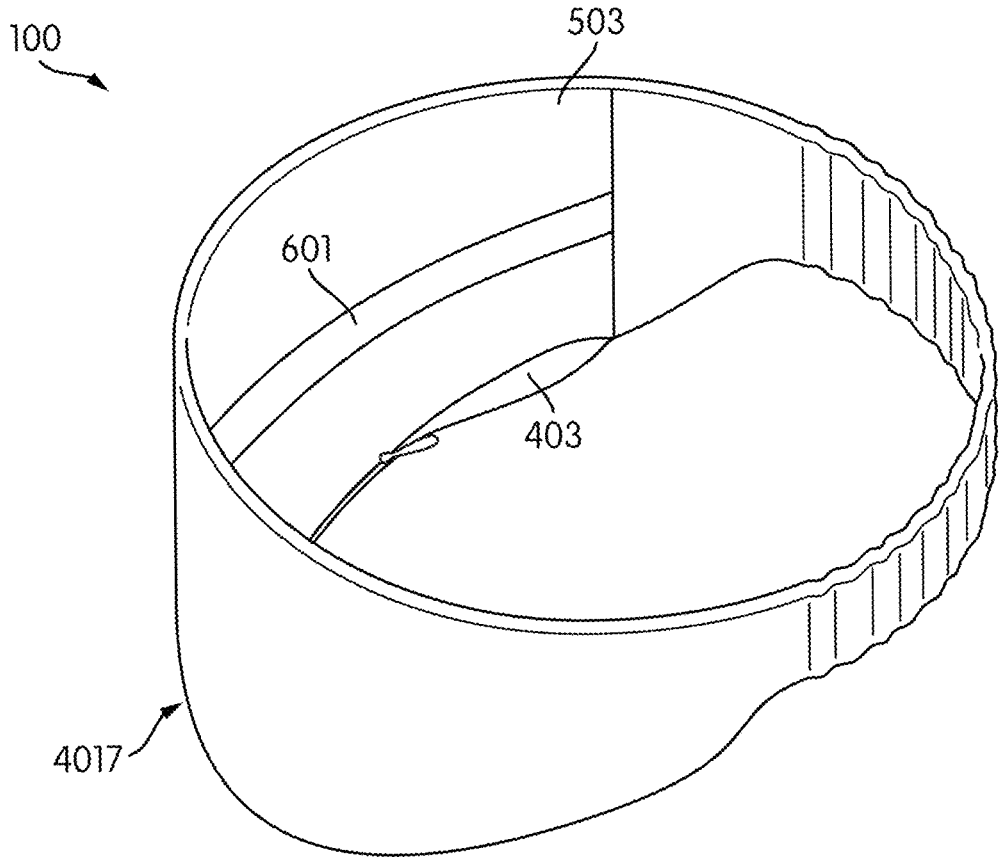
FIG. 6 shows a perspective view of an article of headwear having a zipper according to an embodiment of the disclosure.

Referring to FIGS. 4-6, in one embodiment, the headwear 100 includes at least one opening 403 to permit the insertion of an electronic device 450, such as, but not limited to, a personal audio device. The electronic device 450 includes at least one microprocessor 451 and an audio delivery device 453 at least partially contained within an interior portion 405 of the headwear. The audio delivery device 453 is coupled to the at least one microprocessor 451 to play sounds and/or music from the microprocessor 451 such as, but not limited to, pre-recorded tones, pre-recorded white noise, real-time music, ambient noise, voices, voice memos, affirmations, messages from other people, educational content, or a combination thereof.

In a further embodiment, the headwear 100 includes an expanded portion 407, the interior portion 405 of the expanded portion 407 forming a storage area within the headwear 100. In a first orientation, geared towards physical activity, the expanded portion 407 extends upwards from the headwear 100 and is positioned on top of the wearer's head (see FIG. 6). The edges of the headwear 100 may be reinforced to maintain the storage area against the wearer's head. In another orientation, geared towards rest, mediation, sleep, or the like, the expanded portion 407 extends downward from the headwear 100 towards a hollow of the wearer's neck and the base of the wearer's skull (see FIGS. 4-5) or extends up to the vertex of the skull. The downward extending portion reduces or eliminates discomfort from components within the expanded portion while the wearer is lying down. The material supporting the wearer's head may also provide additional comfort to the wearer.

Figure 7:
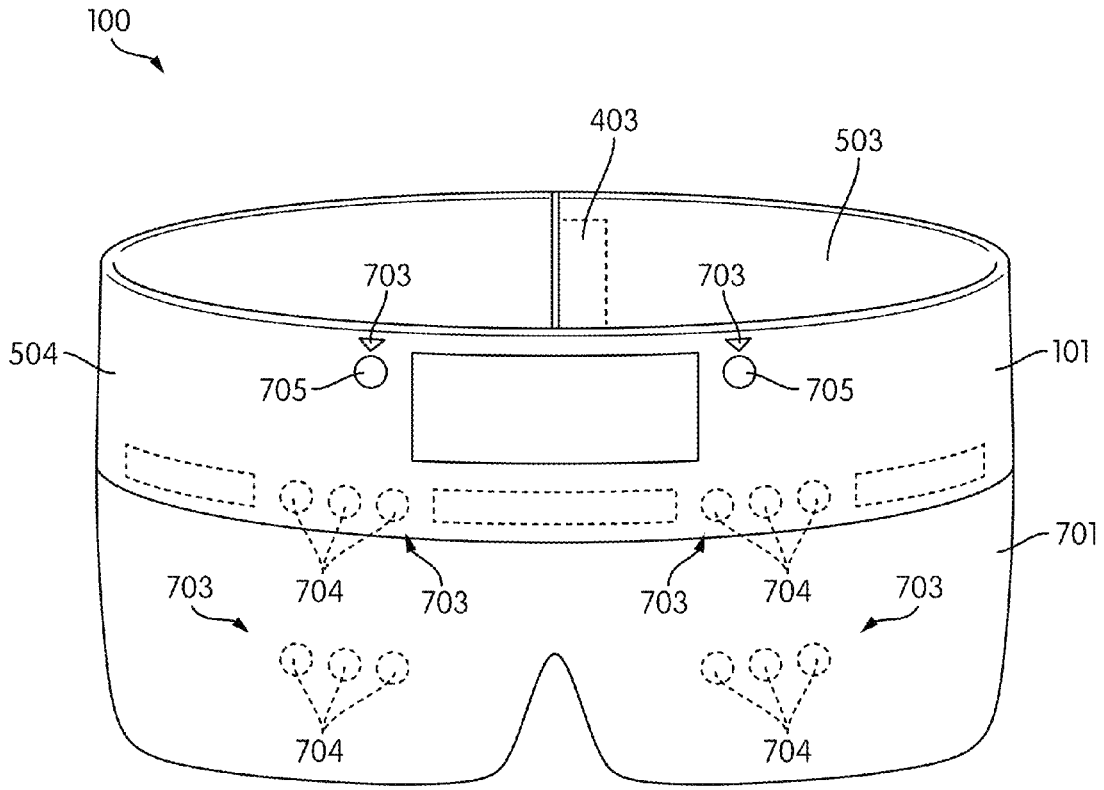
FIG. 7 shows a perspective view of an article of headwear including an eye mask according to an embodiment of the disclosure.

Referring to FIG. 6, in one embodiment, the headwear 100 includes a positioning material 601 such as, but not limited to, rubber, silicone, velvet, other material to maintain the position of the headwear 100, or a combination thereof, on the inner face 503 to help keep the product in place on the wearer's head. In another embodiment, the headwear 100 includes scent inserts secured to and/or positioned within the headwear to provide scents and/or aromatherapy. Referring to FIG. 7, additional embodiments include eye flaps 701 and/or eye shades secured to the headwear 100. The eye flaps 701 and/or eye shades are either integral with or detachably secured to the headwear 100. The headwear 100 may also include an integrated eyewear retainer in the form of, but not limited to, clips, grips, pockets, and/or sleeves position to hold eyewear on the wearer's head. The integrated eyewear retainer is affixed to the inner face 503, the outer face 504, or integrated into the headwear 100, and is particularly formed to secure the eyewear during strenuous activity.

In another embodiment, the article of headwear includes a barrette-like comb attachment 103 (see FIG. 1) and/or protrusions, such as cups, that grip a wearer's hair or skin. The protrusions may be attached to edges of the headwear 100, the inner face 503, the outer face 504, or a combination thereof. In one embodiment, the comb attachment 103 and/or the protrusions maintain the headwear 100 in any suitable position. Suitable positions of the headwear 100 include, but are not limited to, functional positions, cosmetic positions, or a combination thereof. The protrusions may also support the wearer's hair in a predetermined position. For example, in one embodiment, the protrusions engage the wearer's hair to hold an audio delivery device 453 over the ear while the wearer is sleeping. In another example, the protrusions maintain the headwear 100 in place during activities, strenuous ones in particular. In a further embodiment, a visor protrusion is secured to the headwear 100 to shield the wearer from sun, rain, and other conditions. The visor protrusion may be either permanently secured to the headwear 100, or detachably secured with hook and loop fasteners, tabs, slots, or other suitable attachment members.

In a further embodiment, the headwear may be stored conveniently on the person when not in use, such as on an epaulette.

Audio Delivery Device

Figure 8:
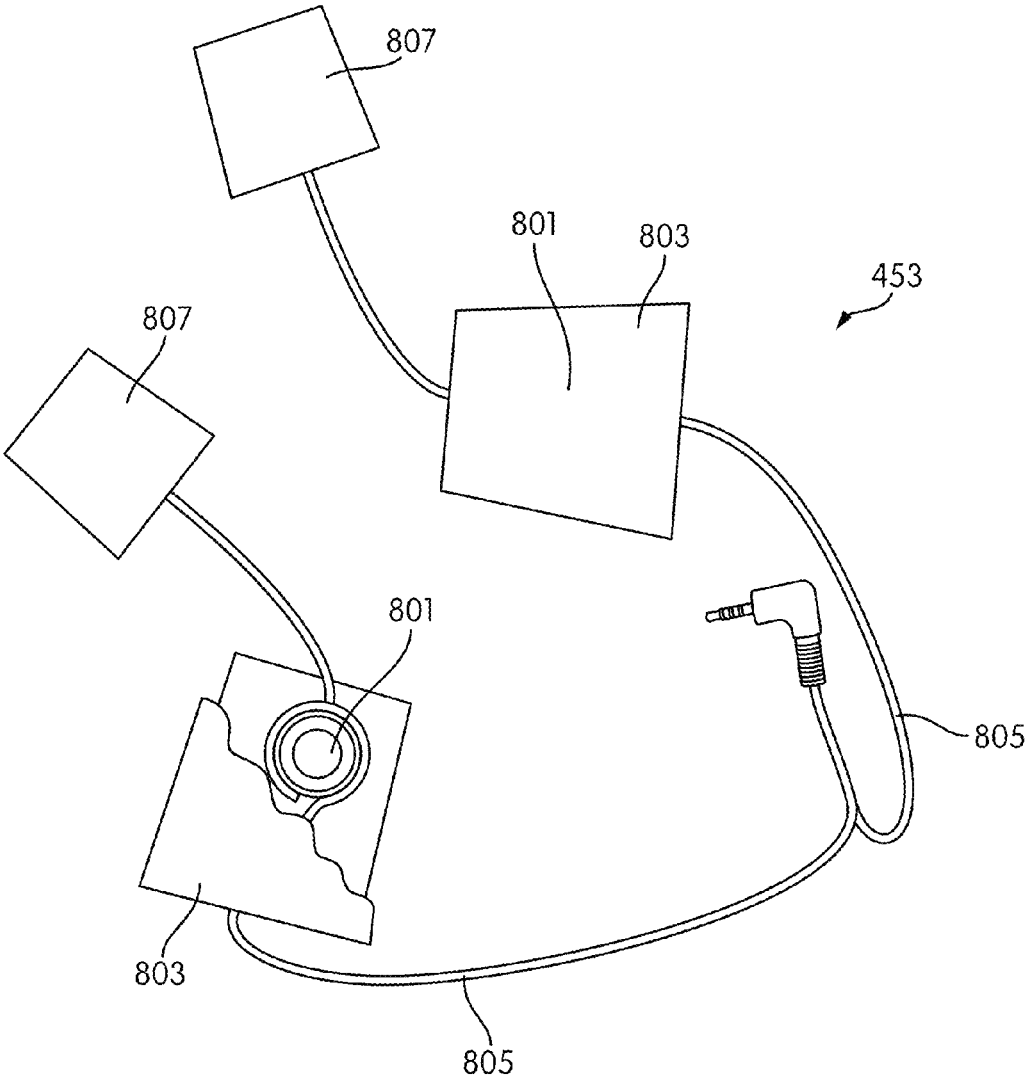
FIG. 8 shows a perspective view of an audio delivery device according to an embodiment of the disclosure.

As illustrated in FIGS. 4-5 and 8, the audio delivery device 453 includes speakers 801. Referring to FIGS. 4 and 8, the audio delivery device 453 may also include additional speakers 807, such as, for example, transducers, infra sound transducers, bone conduction devices, or a combination thereof. In one embodiment, the audio delivery device 453 is movable within the headwear 100, permitting a wearer to situate the audio delivery device 453 in a suitable position, such as over the wearer's ears when the headwear 100 is in use. In another embodiment, the audio delivery device 453 is maintained in a predetermined position within the headwear 100 during use. The position of the audio delivery device 453 is maintained by any suitable method such as, but not limited to, pressure from positioning the headwear 100 on the wearer's head, friction between the audio delivery device 453 and the interior portion 405 of the headwear, securing means on the inner face 503 of the headwear, or a combination thereof.

In another embodiment, a space is provided between the wearer's ears and the speakers 801 to permit the wearer to clearly hear outside sounds. Alternatively, there may be a hole in the speaker assembly to allow the outside sounds. The outside sounds may include important noises, such as, but not limited to, a baby crying, a fire alarm, approaching traffic, or emergency vehicles.

Referring to FIGS. 8-12, in one embodiment, the audio delivery device 453 includes the speakers 801 enclosed in individual speaker enclosures 803. The individual speaker enclosures 803 may be soft, flexible, and/or include padding to provide comfort. In another embodiment, the individual speaker enclosures 803 are removable from the interior portion 405 of the headwear 100. The individual speaker enclosures 803 may be any suitable enclosure for supporting the speaker.

Figure 10:
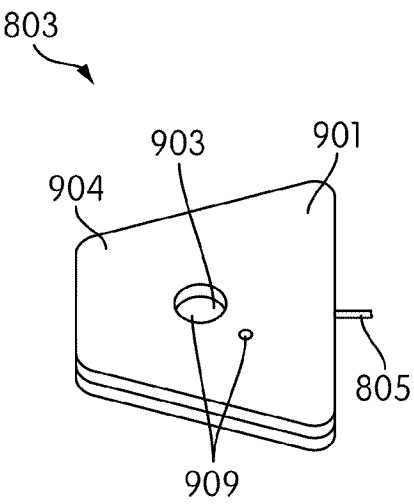
FIG. 10 shows a perspective view of the speaker enclosure of FIG. 9.
Figure 9:
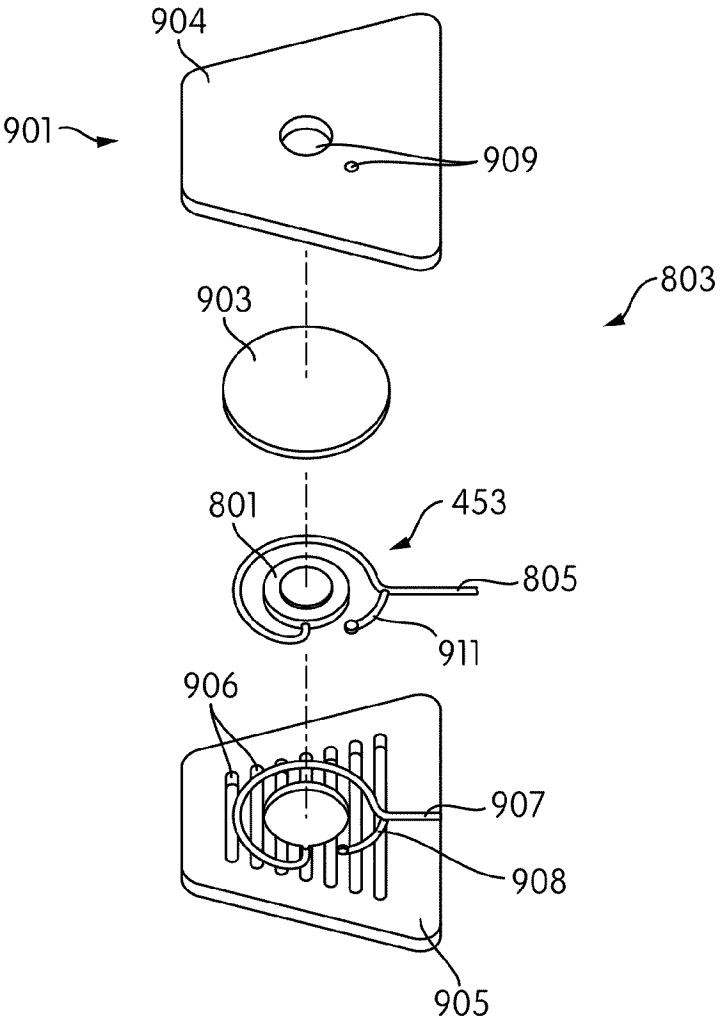
FIG. 9 shows an exploded view of a speaker enclosure according to an embodiment of the disclosure.

For example, referring to FIGS. 9-10, in one embodiment, the speaker enclosures 803 include silicone patches 901, each of the silicone patches 901 including an interior portion 904 and an exterior portion 905. The speaker 801 is positioned between the interior portion 904 and the exterior portion 905, forming an enclosure around the speaker 801. A fabric 903 may be positioned between the speaker 801 and the interior portion 904 to provide padding while permitting sound transmission. In another embodiment, the exterior portion 905 of the silicone patch 901 includes a plurality of openings 906, a speaker wire channel 907, and/or a noise cancellation channel 908. The plurality of openings 906 permit sound transmission there through, while the speaker wire channel 907 receives a speaker wire 805 exiting the speaker 801. The noise cancellation channel 908 receives a noise cancellation device 911 therein, when present. The interior portion 904 includes one or more apertures 909 therein, the apertures 909 corresponding to the speaker 801 and/or the noise cancellation device 911.

The speaker wire channel 907 extends from the speaker 801 to an edge of the silicone patch 901 where the speaker wire 805 exits. In one embodiment, as illustrated in FIG. 9, the speaker wire channel 907 extends from the speaker 801 and bends/wraps approximately 270° around the speaker 801 before reaching the edge of the silicone patch 901 where the speaker wire 805 exits. The bending/wrapping of the speaker wire channel 907 provides slack in the speaker wire 805, which reduces tension at a connection point between the speaker 801 and the speaker wire 805. The reduced tension at the connection point reduces or eliminates breaking of a solder joint when the speaker wire 805 is being stretched.

Figure 12:
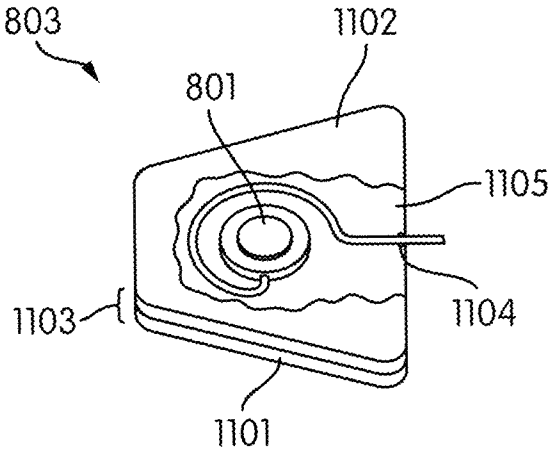
FIG. 12 shows a perspective view of the speaker enclosure of FIG. 11.
Figure 11:
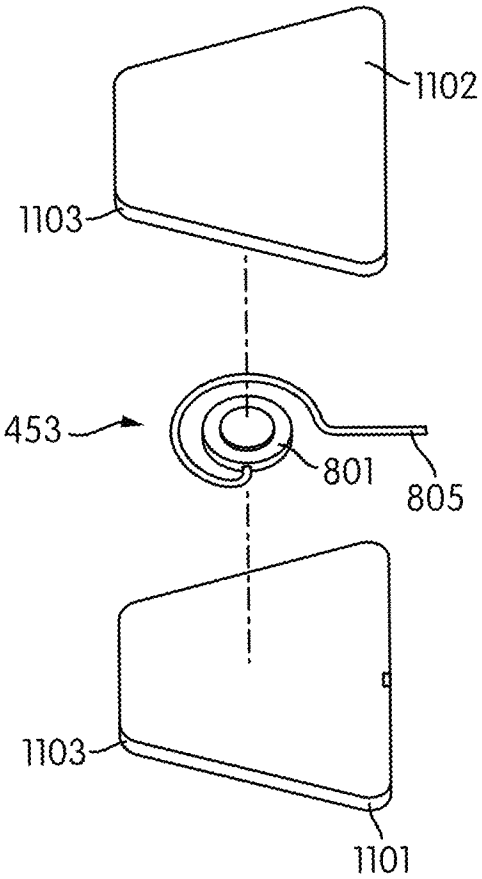
FIG. 11 shows an exploded view of a speaker enclosure according to an embodiment of the disclosure.

Referring to FIGS. 11-12, in an alternate embodiment, two fabric patches 1101, 1102 are sewn together to surround each individual speaker 801 and form the individual speaker enclosure 803. Edge portions 1103 of the fabric patches 1101, 1102 may be secured to retain the speaker 801 therein. Securing of the edge portions 1103 includes, but is not limited to, sewing, mating sections (i.e. hook and loop), or a combination thereof. In one embodiment, an opening 1104 is provided in the edge portion 1103 of the fabric patches 1101, 1102 to permit passage there through of the speaker wire 805 that connects to the speaker 801 to the rest of the audio delivery device 453.

In one embodiment, the speaker enclosure may be stiffened with a stiffening material 1105 in a central portion of the enclosure 803. The stiffening material 1105 is any suitable material to provide additional rigidity such as, but not limited to, batting, cardboard, or a combination thereof. In one embodiment, at least one portion of the speaker enclosure 803 includes fabric, silicone, plastic, rubber, foam, or other material that has sound dampening capabilities. In another embodiment, the speaker enclosure 803 includes different color, fabric, silicone, plastic, rubber, foam, or other material to denote a left speaker versus a right speaker in a stereo assembly. When the individual speaker enclosures 803 are removed from the headwear 100, the different colors and/or materials of the speaker enclosures 803 provide an indication to the wearer for proper re-insertion into the headwear 100.

Referring to FIGS. 8-12, one or more portions of the speaker enclosure 803 may be angled or tapered to permit easier insertion of the speaker enclosure 803 into an opening in the headwear 100. For example, the speaker enclosure 803 may form a shape resembling, but not limited to, a square attached to a trapezoid on one end, a trapezoid, an oval, a square attached to a triangle, or a combination thereof. The angle or tapered portion of the speaker enclosure 803 may also maintain, or substantially maintain the position of the speaker 801 within the headwear 100, such as by preventing the speaker enclosure 803 from entering a narrowing portion of the headwear 100. In one embodiment, the material of the speaker enclosure 803 provides friction between the speaker enclosure 803 and the headwear 100. In another embodiment, the material of the speaker enclosure 803 providing friction includes a pile of two fabrics or grip-like ridges in a rubbery material like silicone. The friction maintains the position of the speaker 801 within the headwear 100 during normal use without impeding easy insertion and removal of the speaker enclosure 803 from the headwear 100.

In one embodiment, the speaker enclosures 803 are designed to hold the audio delivery device 453 firmly in place relative to the headwear 100. This reduces or eliminates rubbing together of the speakers 801, speaker enclosures 803, and/or headwear 100 to reduce or eliminate creation of a static discharge that may adversely affect the speakers 801, wiring 805, and/or other electronics of the electronic device 450. Adverse affects include, but are not limited to, unintentional triggering of a smartphone and/or player controls (e.g., play/pause functions, fast forward and/or reverse, volume functions), interruption of music/sounds played through the audio deliver device 453.

In an alternate embodiment, the speaker enclosures 803 and/or the headwear 100 may be treated with an antistatic agent containing metals, hydrophobic, or hydrophilic substances. In addition to antistatic effects, the hydrophobic coatings may create a waterproofing effect allowing for underwater use of the assembly. A composition of the speaker enclosures 803 may also include materials that reduce the generation of static and/or possibly insulating materials.

In an alternate embodiment, the audio delivery device 453 is worn without a surrounding headband 101. For example, any suitable method of attachment, such as, but not limited to, clips, hook and loop fasteners, or hooks may be affixed directly to the speakers 801 and/or individual speaker enclosures 803. The speakers 801 and/or the individual speaker enclosures 803 may be connected to any article of clothing, including a hat, a hood, a collar, or to the wearer's hair.

Insertion or inclusion of a plurality of audio delivery devices 453 within the headwear 100 creates a more immersive listening experience. The plurality of audio delivery devices 453 includes any suitable combination of audio delivery devices 453, such as, but not limited to, two or more speakers 801, at least one transducer, at least one infra sound transducer, at least one bone conduction device, at least one passive radiator or a combination thereof. The plurality of audio delivery devices 453 enhances the experience of hearing sounds or experiencing sensations generated in a 3D space around the head. In one embodiment, specially crafted tracks, coupled with the placement of the plurality of audio delivery devices 453, take advantage of the natural placement of ears on either side of the head.

The Infra sound or ultrasonic transducers are transducers which create sensation such as vibrations outside of the normal range of human hearing. In one embodiment, the infra sound transducers are provided to generate sounds beyond the range of human hearing and/or support certain sound technologies designed to affect the wearer, even though they are outside the range of human hearing.

Junction Or Device Within Headband

Figure 13:
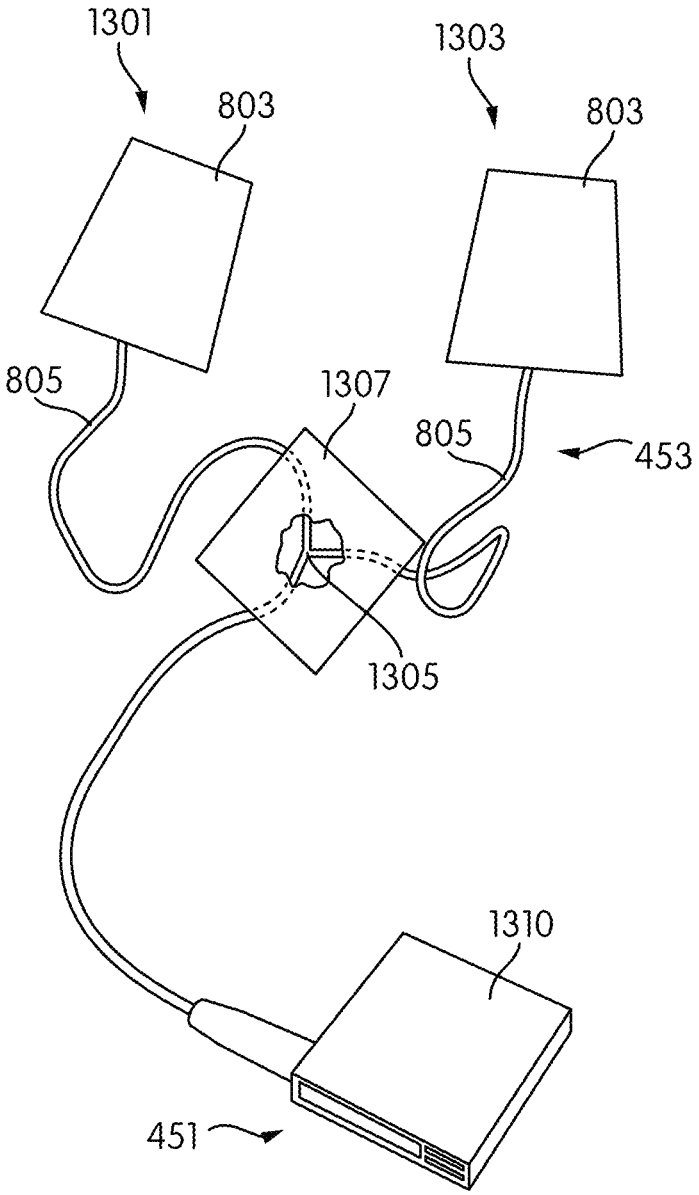
FIG. 13 shows a perspective view of an audio delivery device coupled to an audio control unit according to an embodiment of the disclosure.

Referring to FIG. 13, in one embodiment, the wire 805 from the left speaker 1301 and the wire 805 from the right speaker 1303 are secured to each other prior to connecting the speakers 801 of the audio delivery device 453 to the microprocessor 451, forming a speaker wire junction 1305. The speaker wire junction 1305 is either directly enclosed within the headwear 100 or positioned within a housing 1307 and then enclosed within the headwear 100. The housing 1307 permits easy location of the speaker wire junction 1305 within the headwear 100. Additionally, the housing 1307 may provide a handle for removing the speakers 801 from the headwear 100. The housing 1307 includes any suitable housing material having "softness" to reduce or eliminate discomfort to the wearer. Suitable housing materials include, but are not limited to, fabric, silicone, plastic, rubber, foam, other materials that deform when pressure is applied, other materials with similar "softness", or a combination thereof.

In one embodiment, the housing 1307 is shaped to provide an increased ability to locate and/or move the housing 1307 within the headwear 100. In another embodiment, the housing 1307 includes tapered and/or beveled edges to provide an increased ability to move the housing 1307 within the headwear 100. For example, in one embodiment, the housing 1307 has either a rectangular or a lozenge shape.

In another embodiment, an outside surface of the housing 1307 is coated with a housing coating material that reduces friction between the housing 1307 and the headwear 100. Suitable materials for the housing coating material include, but are not limited to, fabric (e.g. satin), silicone, plastic, rubber, foam, other material which provides reduced friction (slickness), or a combination thereof. The reduced friction permits the housing 1307 to move within the headwear 100 during use, and/or be removed when desired. In another embodiment, the outside surface of the housing 1307 is a fabric with a pile that does not grip the surrounding headwear 100.

Audio Control Unit

Figure 14A:
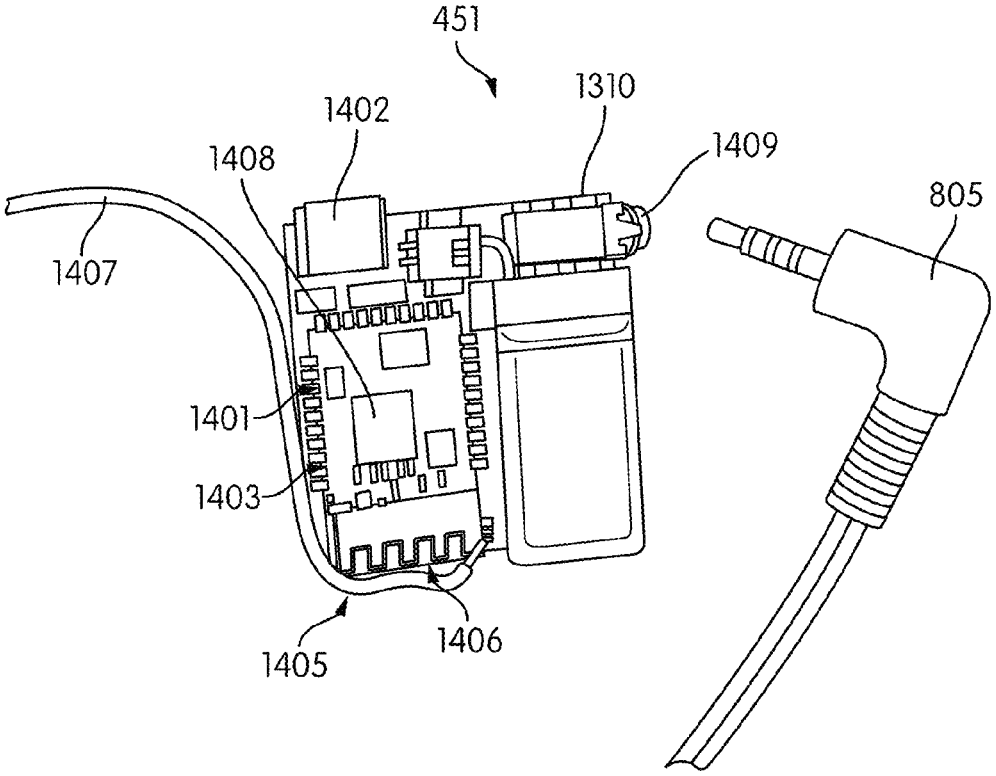
FIG. 14A shows a top view of an audio control unit according to an embodiment of the disclosure.
Figure 14B:
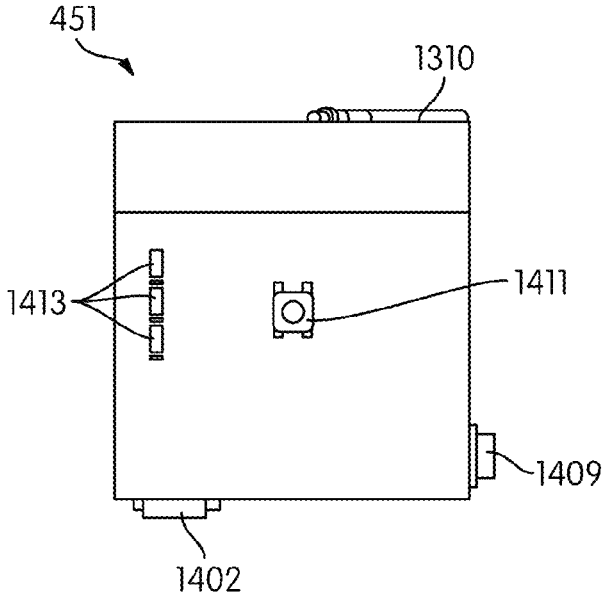
FIG. 14B shows a bottom view of the audio control unit of FIG. 14A.

Referring to FIGS. 13-14B, in one embodiment, the at least one microprocessor 451 includes an audio control unit 1310 (see FIG. 13), which is connected to the audio delivery device 453 to control the audio output provided to the wearer. In another embodiment, the audio control unit 1310 includes an amplifier 1401 for producing audio output, any suitable storage media 1403, and/or any suitable receiver 1405. In a further embodiment, as illustrated in FIG. 14B, the audio control unit 1310 includes a button 1411 and/or one or more light emitting diodes (LEDs) 1413. The button 1411 provides a manual control of the audio control unit 1310, while the light emitting diodes 1413 indicate a status of the audio control unit 1310.

Referring to FIG. 14A, suitable receivers 1405 include any receiver capable of receiving audio input from an external and/or third party device (external device) such as, but not limited to, wireless receivers (e.g. FM radio, WiFi, Bluetooth®), wired receivers, or a combination thereof. The external device includes, for example, a third-party music player, a microphone 1701 (see FIG. 17), or any other audio source. The input from the external device is received by the audio control unit 1310 through any suitable input including, but not limited to, an input jack 1402, a lead, a standard Bluetooth® transceiver 1408, an antenna 1406, or a combination thereof. The amplifier 1401 within the audio control unit 1310 then permits playback of the audio input received by the receiver 1405 directly through the audio delivery device 453 (see FIG. 4).

In one embodiment, antenna leads 1407 and/or additional antennas may be added to improve reception and reduce drop outs. In another embodiment, the antenna 1406 on the audio control unit 1310 is attached to an extra wire included in the cord which connects the audio delivery device 453 to the audio control unit 1310 or other module. The antenna 1406 may be connected to a microphone segment of an audio jack 1409. Using this method, the antennae 1406 may run through a long wire in the audio delivery device 453. In a further embodiment, a separate antenna module is added, including any suitable antenna, such as a fractal antenna.

In another embodiment, the storage media 1403 records the audio input received by the receiver 1405, permitting playback of the audio input from the external device at a later time. Suitable storage media 1403 includes any storage media capable of recording and/or storing (storing) audio information such as, but not limited to, internal media, audio decoder, digital to analog converter, micro-controller unit, integrated circuit with memory removable media, random-access memory, hard disk drives, flash memory (e.g. SD, micro SD), or a combination thereof. The amplifier 1401 within the audio control unit 1310 permits playback of the stored audio information on the storage media through the audio delivery device 453.

For example, the microphone 1701 and the storage media 1403 may be coupled to form a recorder (e.g. voice recorder). The recorder permits the wearer to record voice memos, affirmations, education content, lectures, or any other sound using the microphone 1701, then play the sounds through the audio delivery device 453 when desired. The microphone may be a throat microphone 1703 (see FIG. 17), wired, wireless, or a combination thereof. The microphone 1701 is situated in any suitable position relative to the wearer such as, but not limited to, attached to the headwear 100, detachably secured to the headwear 100, attached to a necklace (e.g. choker; see FIG. 17), or a combination thereof.

Microprocessor And Integrated Hardware

Figure 15:
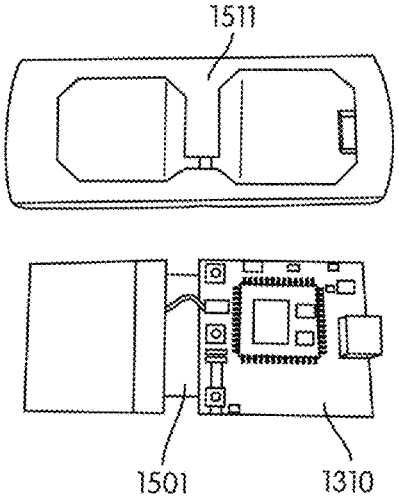
FIG. 15 shows a perspective view of a flexible audio control and cover according to an embodiment of the disclosure.
Figure 16:
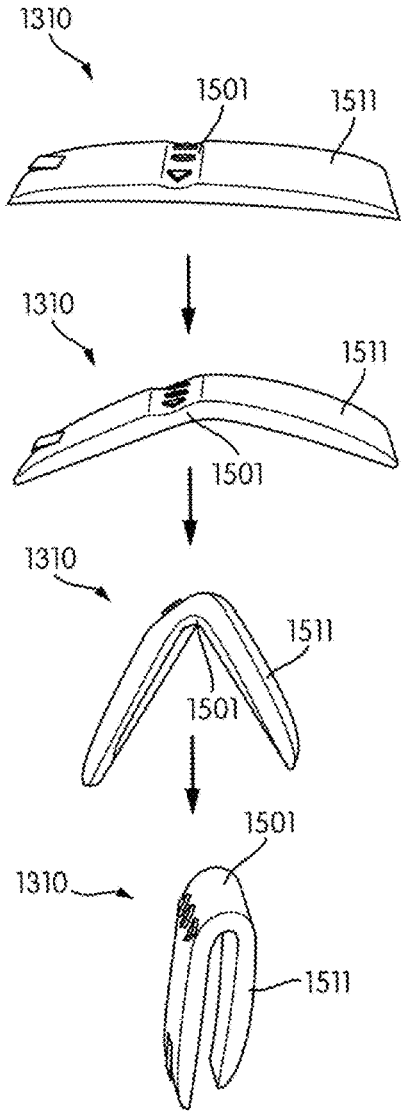
FIG. 16 shows a process view of the audio control unit of FIG. 15 flexing.
Figure 17:
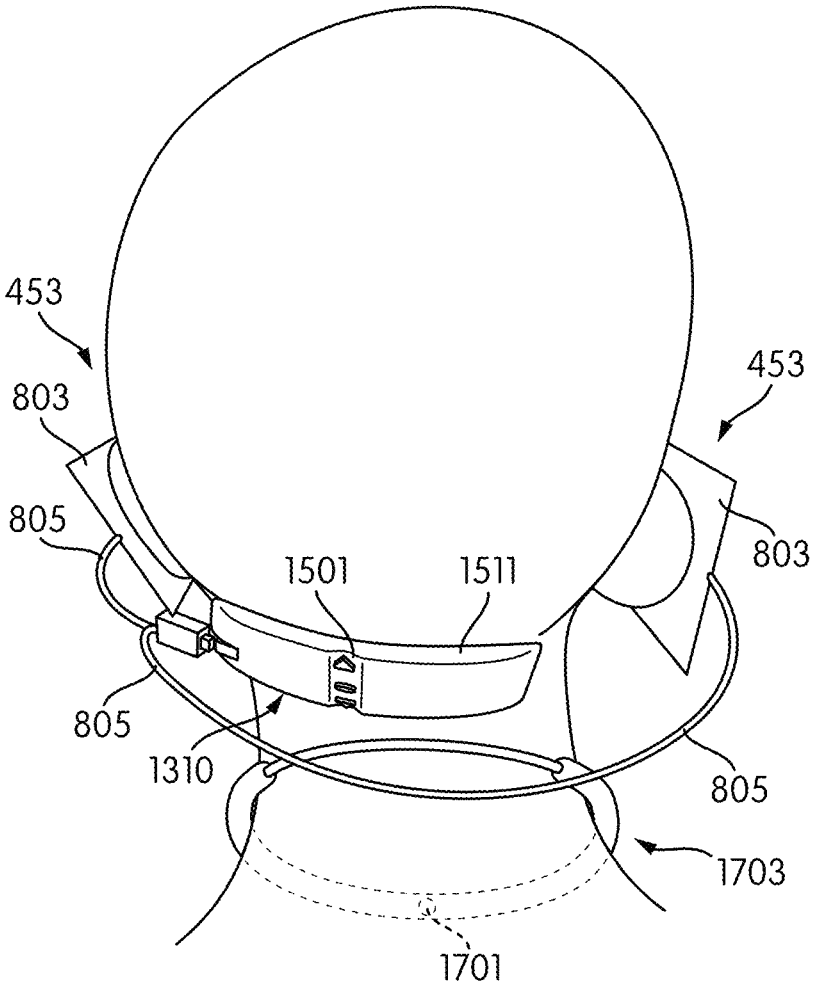
FIG. 17 shows a perspective view of the audio control unit of FIG. 15 flexing around the curvature of a head.

In one embodiment, as illustrated in FIGS. 15-17, the microprocessor 451 and/or the audio control unit 1310 is designed to flex at a joint 1501. In another embodiment, a covering 1511 is positioned partially around the microprocessor 451. The microprocessor 451 and the covering 1511 flex together at the joint 1501, as shown in FIG. 16. When positioned against a wearer's head, the flexing of the microprocessor 451 and/or the covering 1511 molds the components around the natural curvature of the head. This reduces the feeling of the hard components when laying on a surface such as a pillow or the visible bulkiness of hard components through a thin fabric.

Figure 18:
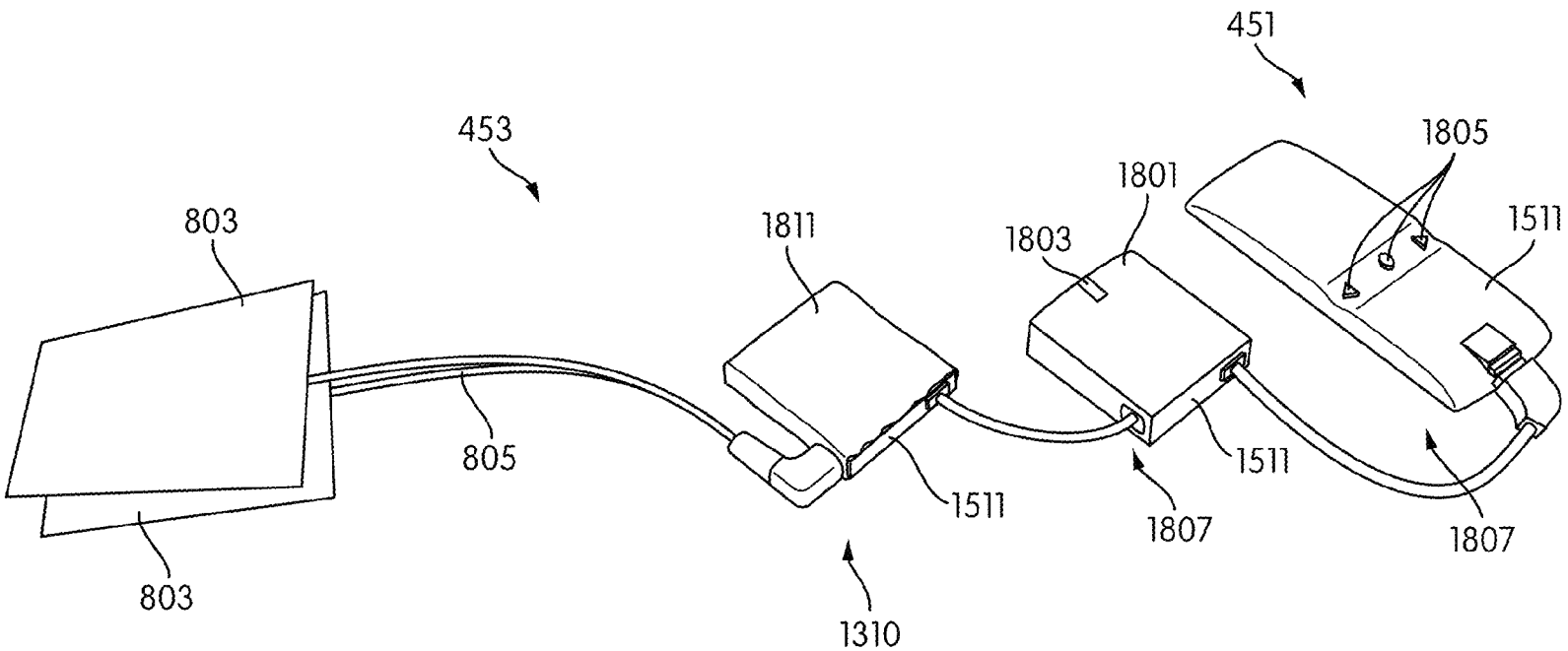
FIG. 18 shows a perspective view of an audio delivery device coupled to a plurality of modules.

Referring to FIG. 18, in one embodiment, the microprocessor 451 and/or the audio control unit 1310 is coupled with integrated hardware 1801 and/or software. The integrated hardware 1801 and/or software includes any device, module, and/or integrated sensor 1803 disclosed herein. In another embodiment, the sound is generated algorithmically by the integrated hardware 1801 and/or software, with or without parameters supplied by integrated sensors 1803. The sensors 1803 may use data from other environmental features, other devices the user is using, servers, internet, historical metrics, or metrics from other users. The algorithmically generated sounds include any suitable sound that follows defined heuristics designed to create certain effects. Suitable sounds include, but are not limited to, music constrained to certain scales, arpeggios, groupings of intervals, dynamic changes, tempo changes, timbre changes, chord changes, sounds from a table of stored sounds, sounds from an online server, or a combination thereof. The table of stored sounds is a series of stored sounds that are replayed programmatically when initiated by an algorithm. The sounds from the table of stored sounds are played at predetermined intervals, dynamically changing intervals based on sensor input/remote input, or other changing conditions. In a further embodiment, the algorithmically generated sounds and/or music integrates sounds sampled from the wearer's surroundings to be played back as part of the audio control unit 1310 output. The sounds from the wearer's surroundings are either played back directly, or altered prior to being played back, to form a "sound screen". For example, the audio control unit 1310 may generate a symphony of snore-like sounds from actual snoring in the wearer's surroundings to distract the wearer from the actual snoring (snoring camouflage). The "sound screen" may help to isolate the wearer from the distracting and/or disturbing sounds of the external environment. In one embodiment, hardware 1801 and/or software may be included to listen for outside sounds, such as snoring. The device may play a different sound when the snoring is detected. For example, the device may play the sound of an ocean's roar or a train whistle each time it detects a snore.

The parameters supplied by the integrated sensors 1803 include, but are not limited to, music provided by an external player, sounds present in the wearer's surroundings, data supplied by an external server, metrics describing the wearer's orientation recorded by an integrated accelerometer, metrics describing the wearer's motion (i.e. as recorded by the accelerometer), metrics describing the wearer's physical state, metrics describing the wearer's mental state, metric describing the wearer's surroundings (i.e. temperature, breeze, humidity), other measurements provided by additional features and/or components disclosed herein, or a combination thereof. Other measurements include, for example, varying galvanic skin responses of the wearer, electromagnetic radiation given off by the wearer's body, electroactivity such as electroencephalography (EEG) measured by an EEG device, the wearer's pulse, the wearer's oxygen level, the wearer's temperature, the wearer's eye movements, or a combination thereof.

In another embodiment, the integrated hardware 1801 and/or software in the electronic device 450 includes a receiving module configured to receive new data, sounds, music, or other information from a remote server. The remote server provides the microprocessor 451 with any suitable information such as, but not limited to, email alerts, news events, weather forecast information, movements of the stock market, indexes based on social media trends, instant messages, intruders, fire alarms, emergencies, health issues, dangerous levels of carbon monoxide, combined metrics from other users, or a combination thereof.

In one embodiment, the microprocessor 451 and/or the audio control unit 1310 includes mixing circuitry capable of layering various sounds. Together, the microprocessor 451 and/or the audio control unit 1310 along with the mixing circuitry forms a sound layering module. Alternatively, the hardware 1801 may include the mixing circuitry, forming the sound layering module separate from the microprocessor 451 and/or the audio control unit 1310. The sound layering module mixes the sound received from the external device, the stored audio information in the audio control unit 1310, and/or the sound generated by the audio control unit 1310 to provide a layered audio output to the wearer through the audio delivery device 453. The sounds may feature automatic ducking of a layer or selecting left or right channels. For example, the sound layering module permits a wearer to record affirmations through the microphone 1701 and play the affirmations back directly, mix the affirmations with pre-recorded sounds and/or music stored on the storage media 1403, mix the affirmations with sounds and/or music played by an external device, mix the affirmations with sounds and/or music generated algorithmically, or a combination thereof.

In another embodiment, the sound layering module includes a user interface 1805 permitting the wearer to control the music and/or sounds played by the sound layering module. For example, the user interface 1805 may permit the wearer to select stored audio information, transmitted sounds from an external device, or algorithmically generated sounds and either play the selection directly through the audio delivery device 453 or mix the selections with the sound layering module prior to being played through the audio delivery device 453.

The user interface 805 may also include the button 1411 and/or any other article capable of being depressed to track events or behaviors. The button 1411 may be part of the microprocessor 451, the audio control unit 1310, and/or the hardware 1801 (collectively referred to herein as components 1807); or the button 1411 may be sewn or otherwise affixed to the inside or outside of headwear 100. In one embodiment, when the button 1411 is pressed, the components 1807 record a timestamp reflecting the behavior and/or event the wearer intends to track (e.g., when the wearer does something such as going to bed, experiencing a particular thought, smoking a cigarette, taking medication, or performing an exercise). In another embodiment, the components 1807 transmit data describing the button press to an external device, such as a smartphone; transmits the data describing the button press to a server; stores a timestamp associated with the button press in memory within the device; displays the timestamp and/or the series of timestamps recorded so far on an external or internal display; and/or stores the data as data points for a graph. The button 1411 facilitates and/or provides control to eliminate, reinforce, and/or establish habits.

In one embodiment, one or more of the components 1807 are removably situated in any suitable position relative to the headwear 100. Suitable positions include, but are not limited to, resting loosely within the headwear 100, secured within the headwear 100, placed within a pocket on the inside of the headwear 100, placed within a pocket on the outside of the headwear 100, sewn to the headwear 100, detachably secured to the headwear 100 with fasteners, attached to a wire from the audio delivery device 453, or a combination thereof. Each of the components 1807 is either entirely independent, wired together, or in wireless communication with the other components. In one embodiment, the components 1807 are capable of communicating through external devices, such as, but not limited to a smartphone running a custom app that receives wired and/or wireless information (such as via Bluetooth®) from one or more of the components 1807.

In one embodiment, hardware 1801 and/or software includes a volume measuring module configured to measure the volume of noise/sounds in an area surrounding the wearer. The volume measuring module measure the volume using an integrated microphone 1701. In another embodiment, volume measuring module is configured to measure the volume of the sounds playing from the audio delivery device 453. If the volume measuring module determines that the surrounding sound levels are above a predetermined threshold (e.g., above a decibel level known to damage hearing), it directly or indirectly (e.g., through the other components 1807) activates vibrations, sounds, lights, electrical signals, or other stimuli to warn the wearer.

In another embodiment, a wireless receiver adjacent material 1811 configured to serve as a spacer, insulation material, and/or radio wave reflection material is positioned between one or more of the components 1807 and the wearer's head. In another embodiment, the wireless receiver adjacent material 1811 is provided to protect the wearer's head from ambient radiation (such as WiFi signals, power line radiation, etc.), increase the quality of radio reception, decrease the occurrence of dropouts by reflecting and/or blocking radio waves which would otherwise be absorbed by the wearer's body, and/or block electro-magnetic radiation from the wearer's head to improve quality, onset, and length of sleep. The wireless receiver adjacent material 1811 is secured to the headwear 100 in any suitable manner such as integrated within the headwear 100, affixed to the inside surface of the headwear 100, affixed to the outside surface of the headwear 100, or built into the components 1807.

When a device such as the headwear 100 and/or the electronic device 450 is picked up, the position/disposition of the wearer's fingers on the device may determine what functions are to be activated, which applications launched, and/or what behaviors the device exhibits. A manner in which the device is lifted, as determined by an integrated accelerometer, compass, and/or gyroscope may also affect the determination. Different motions/flourishes may activate different functionalities, as determined by the software, to permit a more direct method of controlling the device. For example, by saving the wearer from having to navigate more traditional menus and/or wearer interfaces on the device, and increasing efficiency of the wearer's interaction with the device.

In one embodiment, the electronic device 450 includes one or more of the additional speakers 807 and an associated amplifier 1401, software, and/or circuitry. The one or more additional speakers 807 may produce sounds that can be heard by those not wearing the headwear 100, in the surrounding area. The additional speakers 807 permit the headwear 100 to "yell" or to "call out". In another embodiment, lights 703 (see FIG. 7) are attached to the headwear 100, the lights 703 including internal lights 704 and/or external lights 705. The external lights 705 are visible to nearby individuals, and the internal lights 704 are visible to the wearer. In combination with one or more of the embodiments disclosed herein, the headwear 100 and associated modules may be configured to impose an exercise and/or sleep schedule on the wearer. For example, the lights 703 may be used to tell the wearer to initiate a sleep or exercise session. This schedule may be preprogrammed, or dynamically/algorithmically generated. The schedule may be changed dynamically over time. A display may be added to communicate the wearer's physical status, mental status, interests, abilities, desires, etc. When two users with matching or contrasting interests and/or attributes are near each other, there may be changes in the lights 703, sounds, or display.

Figure 19:
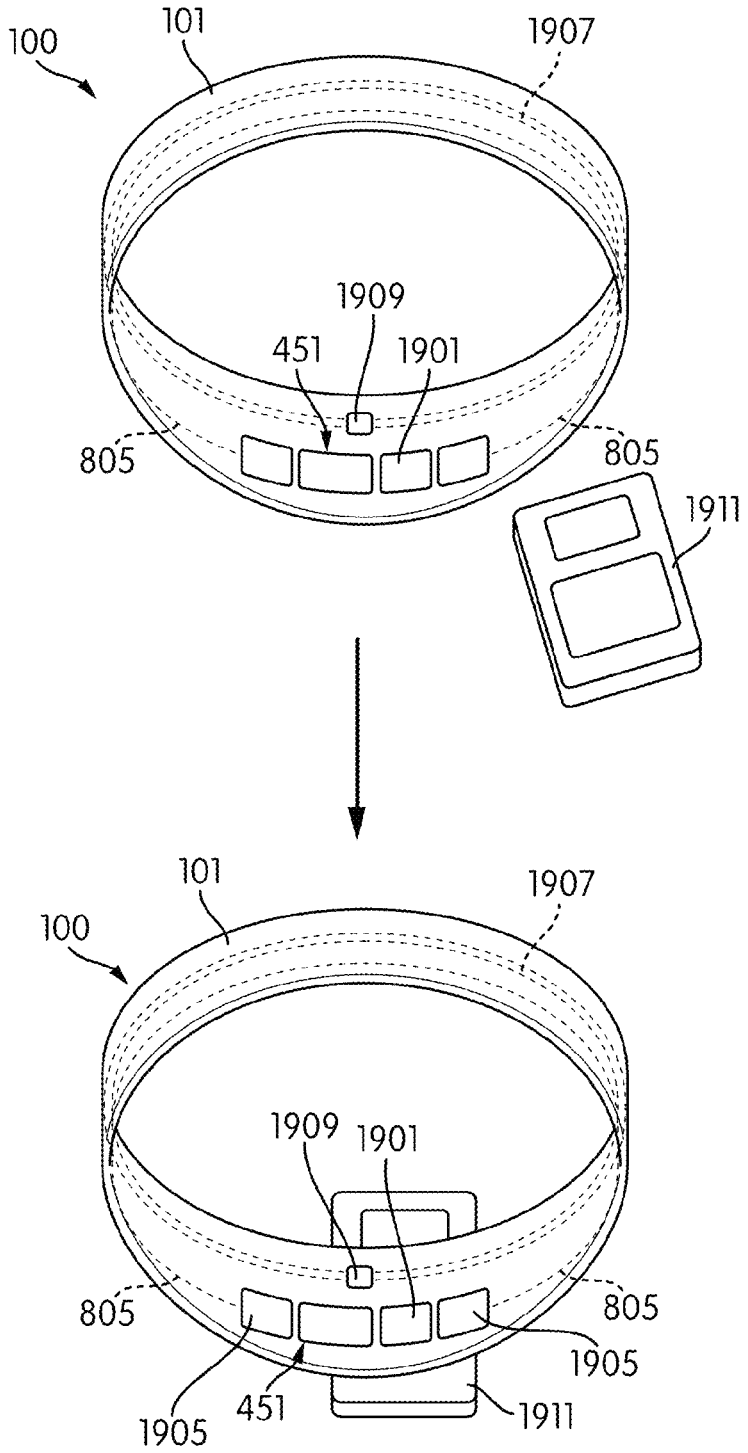
FIG. 19 shows a process view of induction charging according to an embodiment of the disclosure.

Referring to FIG. 19, in one embodiment, a separate power module 1901 is sewn or otherwise affixed to the outside or inside of the headwear 100, and connected to the components 1807 through any suitable connection, such as, but not limited to, a jack. The separate power module 1901 may serve as a power supply which directly and/or indirectly provides power to the components 1807, such as, but not limited to, the Bluetooth® transceiver, the sound layering module, and/or the audio control unit 1310. For example, the power module 1901 may include a rechargeable battery and/or a replaceable/removable battery that directly powers the components 1807. Alternatively, the power module 1901 may recharge a battery of one or more of the components 1807, thus indirectly powering the components 1807.

Figure 20:
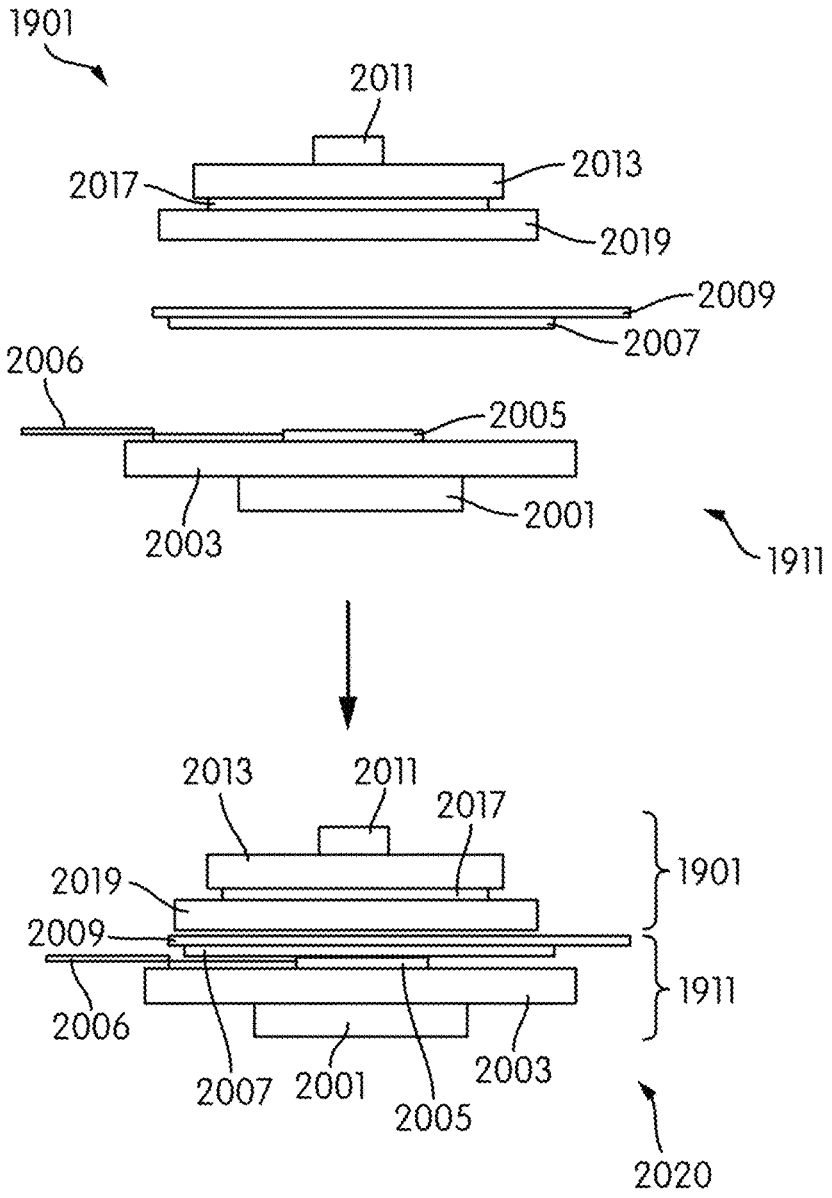
FIG. 20 shows a schematic view of the induction charging of FIG. 19.
Figure 21:
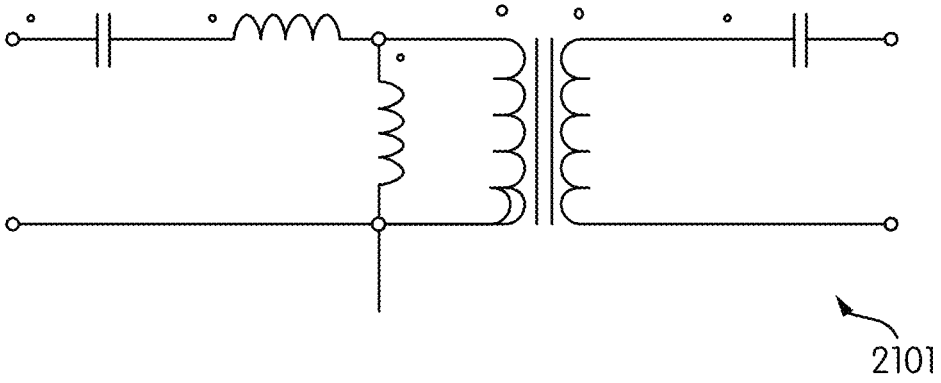
FIG. 21 shows a schematic view of a resonant compensation network for the induction charging of FIG. 19.

The power module 1901 may be recharged via induction charging (i.e., power transmitted via induction coils without a direct connection to the device), via a USB jack, or other charging circuit. For example, referring to FIGS. 20-22, in one embodiment, the power module 1901 is charged with an induction charger 1911, the induction charger 1911 providing induction charging of the power module 1901 with a mixed coil design configured for use within the headwear 100 having a unique size constraint. In another embodiment, the induction charger 1911 includes a base placement magnet 2001, a base ferrite sheet 2003, a sensing coil 2005, and a base coil 2007. The base coil 2007 is positioned between the sensing coil 2005 and a barrier layer 2009 of the induction charger 1911, the sensing coil 2005 including a sensing wire 2006 coupled to a microcontroller. The base ferrite sheet 2003 is positioned between the base placement magnet 2001 and the sensing coil 2005. In a further embodiment, the power module 1901 includes a headset placement magnet 2011, a headset ferrite sheet 2013, and a headset coil 2017. The headset ferrite sheet 2013 is positioned between headset placement magnet 2011 and the headset coil 2017, which is positioned adjacent to a barrier layer 2019 of the power module 1901.

Both the base placement magnet 2001 and the headset placement magnet 2011 are incorporated in the induction charging circuitry, in contrast to typical wireless charging systems which are placed separately from the charging system so as to not interfere with power transfer. The incorporation of the placement magnets 2001, 2011 in the induction charging circuitry decreases an overall size of the induction charging system.

During the induction charging, the power module 1901 and/or the headwear 100 are moved towards the induction charger 1911. As the power module 1901 approaches the induction charger 1911, the base placement magnet 2001 and the headset placement magnet 2011 attract each other, providing a positioning force. The positioning force aligns the power module 1901 with the induction charger 1911, and positions the barrier layer 2009 of the induction charger 1911 adjacent the barrier layer 2019 of the power module 1901 and/or any intervening material of the headwear 100. Additionally, the positioning force moves the base coil 2007 towards the sensing coil 2005. When the base coil 2007 is adjacent to and/or in contact with the sensing coil 2005, the voltage through the sensing wire 2006 increases, which indicates a contacted or charging position 2020. After the sensing wire 2006 indicates a contacted or charging position 2020 wireless charging begins, such as, for example, through the resonant compensation network 2101 illustrated in FIG. 21.

Figure 22:
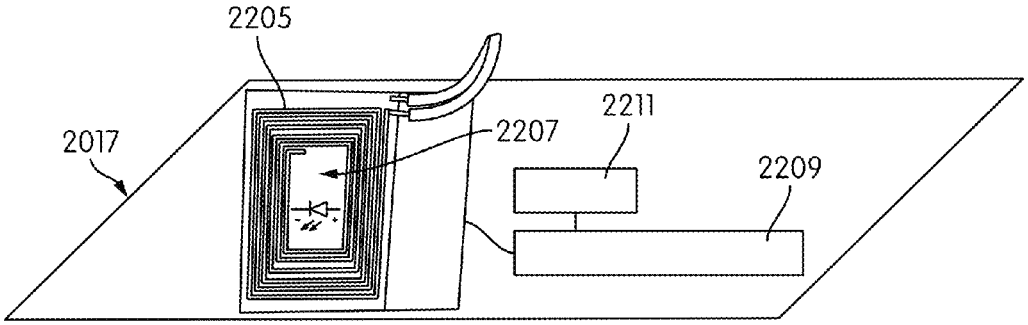
FIG. 22 shows a schematic view of position confirmation in the induction charging of FIG. 19.
Figure 22:
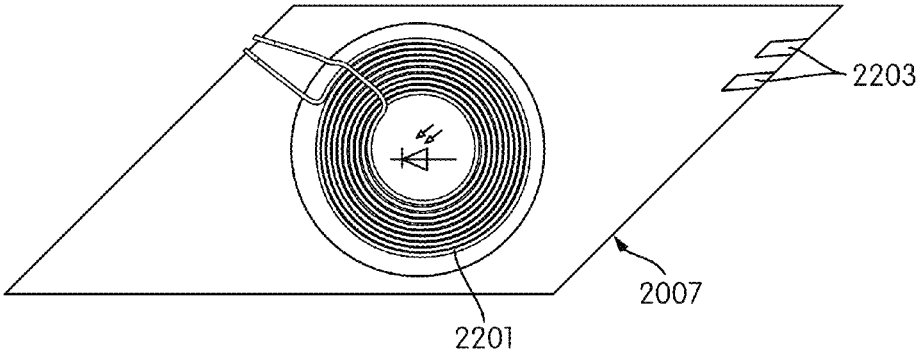

Referring to FIG. 22, in one embodiment, the base coil 2007 includes a primary coil 2201 and one or more light emitting diodes 2203. In another embodiment, the headset coil 2017 includes a printed circuit board (PCB) coil 2205, an infrared LED emitter 2207, and a current sensor 2209. The PCB coil 2205 includes a decreased area and a decreased thickness as compared to the primary coil 2101, facilitating positioning of the PCB coil 2205 within the headwear 100. In another embodiment, the current sensor 2209 is configured to detect a sufficient charging current, such as, for example, when the base coil 2007 and the headset coil 2017 are properly aligned. In a further embodiment, when the current sensor 2209 detects a sufficient charging current a microcontroller 2211 activates the infrared LED emitter 2207, which activates the one or more light emitting diodes 2203 of the base coil 2007. The activated light emitting diodes 2203 of the base coil 2007 indicate proper alignment and induction charging to the user.

Audio Features

In one embodiment, as illustrated in FIG. 9, the microprocessor 451 and/or the audio control unit 1310 includes a noise cancellation device 911. The noise cancellation device 911 includes a noise cancellation receiving portion positioned in any suitable location for receiving sounds originating from a source other than the audio delivery device. For example, referring to FIG. 9-13, in one embodiment, the noise cancellation receiving portion is a pair of noise cancellation microphones positioned within the individual speaker enclosures 803, facing away from the wearer. In one embodiment, apertures are located on the outside of the article of headwear 100 near the position of the speakers 801. The apertures permit the noise cancellation microphones to pick up unwanted external noises as near the ears and speakers as is possible. In another embodiment, the noise cancellation device 911 is paired with a cup-shaped speaker enclosure that reduces or eliminates sound from environmental noise. In a further embodiment, the back of the speaker is cupped and held securely in place by the speaker enclosure 803, reducing vibration of the speaker within the speaker enclosure 803.

The noise cancellation device 911 analyzes the noises received by the noise cancellation receiving portion and generates sound to offset the detected noises without offsetting the sounds and/or music from the audio delivery devices 453. In an alternate embodiment, the integrated hardware 1801 includes the noise cancellation device 911, forming a standalone noise cancellation module residing either within the headwear 100, or outside the headwear 100. The standalone noise cancellation module may be coupled to the microprocessor 451 and/or the audio control unit 1310.

In another embodiment, the microprocessor 451 and/or the audio control unit 1310 includes a background sound module to generate background sounds such as, but not limited to, beats to provide pacing while running, binaural beats to help the wearer fall asleep, a foreign language to help acclimate a wearer to different sounds, subliminal messages, affirmations, hypnosis (e.g. for cessation of smoking), triggers, cues, or a combination thereof. The background sound module may permit building in the background sounds while channeling foreground sounds from the audio control unit 1310. Building the background sounds while channeling the foreground sounds permits the addition of background sounds without modifying the music and/or sounds themselves. In an alternate embodiment, the integrated hardware 1801 includes the background sound module, forming a standalone device residing either within the headwear 100, outside the headwear 100, via software, or smartphone app. The standalone background sound module may be coupled to the microprocessor 451 and/or audio control unit 1310.

In another embodiment, the microprocessor and/or the audio control unit 1310 includes an accelerometer designed to monitor sleep patterns, determine stages of sleep, or determine running/movement amplitude. In another embodiment, the accelerometer is configured to control features of the components 1807, such as, but not limited to, volume, song selection, algorithmically-generated content, or a combination thereof. For example, the accelerometer may be tapped one time for controlling volume, two times for advancing the song, and three times for any other suitable feature control. In an alternate embodiment, the integrated hardware 1801 includes the accelerometer, forming a standalone accelerometer module residing either within the headwear 100, or outside the headwear 100. The accelerometer module may be coupled to the microprocessor 451 and/or the audio control unit 1310.

In another embodiment, the wearer is able to set a wake up alarm sound controlled by either the audio control unit 1310 or any other audio input method, such as a smart phone or music player. This allows the wearer to hear a wake up alarm privately without disturbing others. A proximity alarm may also be incorporated, sounding when the user reaches a particular destination.

In one embodiment, pre-recorded sounds of guided imagery may be played to distract the wearer or to help the wearer establish some habit or thought pattern. Distracting the wearer may be beneficial to help the wearer sleep, stop from ruminating (thinking negative thoughts), achieve mindfulness, or achieve self-hypnotic states, for example. Guided imagery may be crafted specifically to awaken a sense of wonder in the wearer.

In a further embodiment, the microprocessor 451 includes or is coupled to two or more of modules or devices disclosed herein, such as, for example, the audio control unit 1310, the noise cancellation device 911, the wireless receiver unit, the audio player unit, the background sound module, the power module 1901, and/or the accelerometer. The microprocessor 451 combines the features and/or functionality of each of the devices to produce combined effects in the audio output from the audio delivery device 453. For example, the microprocessor 451 may provide noise cancellation in addition to beats to provide pacing during running, while at the same time permitting the wearer to control features of the audio control unit 1310 with the accelerometer.

In one embodiment, when predetermined pre-recorded sounds (e.g., affirmations) are played, the volume of other sounds being played by the device are automatically or dynamically ducked (lowered) to make it easier for the wearer to hear the sound. The ducked sounds may include those from external music players, algorithmically generated music from the present invention, pre-recorded music played by the present invention, and/or any other suitable sound.

Parameter Detection, Analysis, And Feedback

In one embodiment, the electronic device 450 includes one or more integrated sensors 1803 configured to determine and/or store various parameters related to mental state, sleep and/or exercise such as, but not limited to, the wearer's motion, length of time since the wearer's last move, amount of eye movement, rate of eye movement, breathing rate, pulse, pulse oximetry, brainwaves, electroencephalography (EEG) data, the wearer's gait, a number of footfalls, the wearer's varying pace during physical activity (i.e. walking, running, rowing, biking, swimming), or a combination thereof.

One or more of the components 1807 then analyze the parameters obtained by the sensors 1803 to determine the wearer's current mental state, stage of sleep, or exercise level using any suitable method. For example, EEG data may be analyzed to determine the stage of sleep of the wearer, with EEG patterns of predominantly theta or delta waves indicating light or deep sleep, respectively. In another example, determining the exercise level of the wearer includes analyzing pulse rate, consistency of foot falls, and/or EEG data. The one or more components 1807 determine that increasing pulse rate and/or consistency of foot falls indicates increase exercise level, while primarily alpha brainwave activity from the EEG data may indicate a "flow" state or optimum exercise level (e.g., an athlete is "in the zone"). Suitable methods of analyzing the parameters include, but are not limited to, an expert system, fuzzy logic, a neural network, comparison to pre-recorded parameter sets, or a combination thereof. In another embodiment, the components 1807 are capable of comparing the parameters from the wearer in any time period, or to parameters obtained from others. The parameters obtained from the wearer are analyzed either by the components 1807 or in a separate computer or device. In a further embodiment, the components 1807 communicate the parameters obtained from the integrated sensors 1803 to the separate computer or device. The communication is done over any suitable communication means such as, but not limited to, WiFi, Bluetooth®, hardwire, conversion to sound information to be sent through a commodity audio jack, or a combination thereof.

After determining and/or analyzing the parameters from the various sensors, alone or in combination, the components 1807 may detect an activity or behavior of the wearer. In response to the activity and/or behavior the components 1807 may start, stop, and/or modify a particular operation. Suitable behaviors include, but are not limited to, the wearer starting or stopping movement and/or increases or decreases in pace, increases or decreases in physical exertion, rotations in motion, increases or decreases in mental exertion, enter different stages of sleep, or a combination thereof.

In one embodiment, the one or more integrated sensors 1803 may obtain metrics describing the wearer's bodily systems, such as brainwave patterns, heartbeat patterns, or galvanic skin response, to develop a unique, biometric signature that can identify the wearer. One or more of the components 1807 may then communicate the authentication wirelessly to external devices, such as smartphones, vehicles, computers, and the like. In another embodiment, if the headwear 100 is being worn (stretched, as indicated by a stretch sensor), and no vital signs or dangerous vital signs are detected by integrated sensors, the components 1807 may contact emergency services, designated contacts, exercise partners, or any other service or individual. In another embodiment, the components 1807 may transmit the wearer's vital signs, physiological/mental state, how much/long/hard you've been exercising to the external devices. This may be done in the form of a social media post, a text message, proprietary protocol, or other communication.

In one embodiment, the integrated sensors 1803 include movement sensors configured to determine and/or store the wearer's rate of travel, such as through GPS, cell tower signals, WiFi, footfalls, or a combination thereof. The movement sensors provide parameters relating to exercise to the components 1807. When the movement sensors detect that the wearer starts and/or stops running, the audio control unit 1310 increases/starts and/or decreases/stops the music, respectively. In another example, the audio control unit 1310 stops playing music and/or sounds an alarm when the integrated sensors 1803 detect that the wearer's heart rate has reached too great a speed. In yet another example, the audio control unit 1310 changes the music, tempo, volume, and/or sounds being played when the integrated sensors 1803 detect that the wearer has reached a desired level of physical exertion, or fallen below a desired level of physical exertion to push the wearer toward the next level of physical exertion. The response is not limited to the audio control unit 1310, but may include any operation from the other components 1807 disclosed herein.

Figure 24:
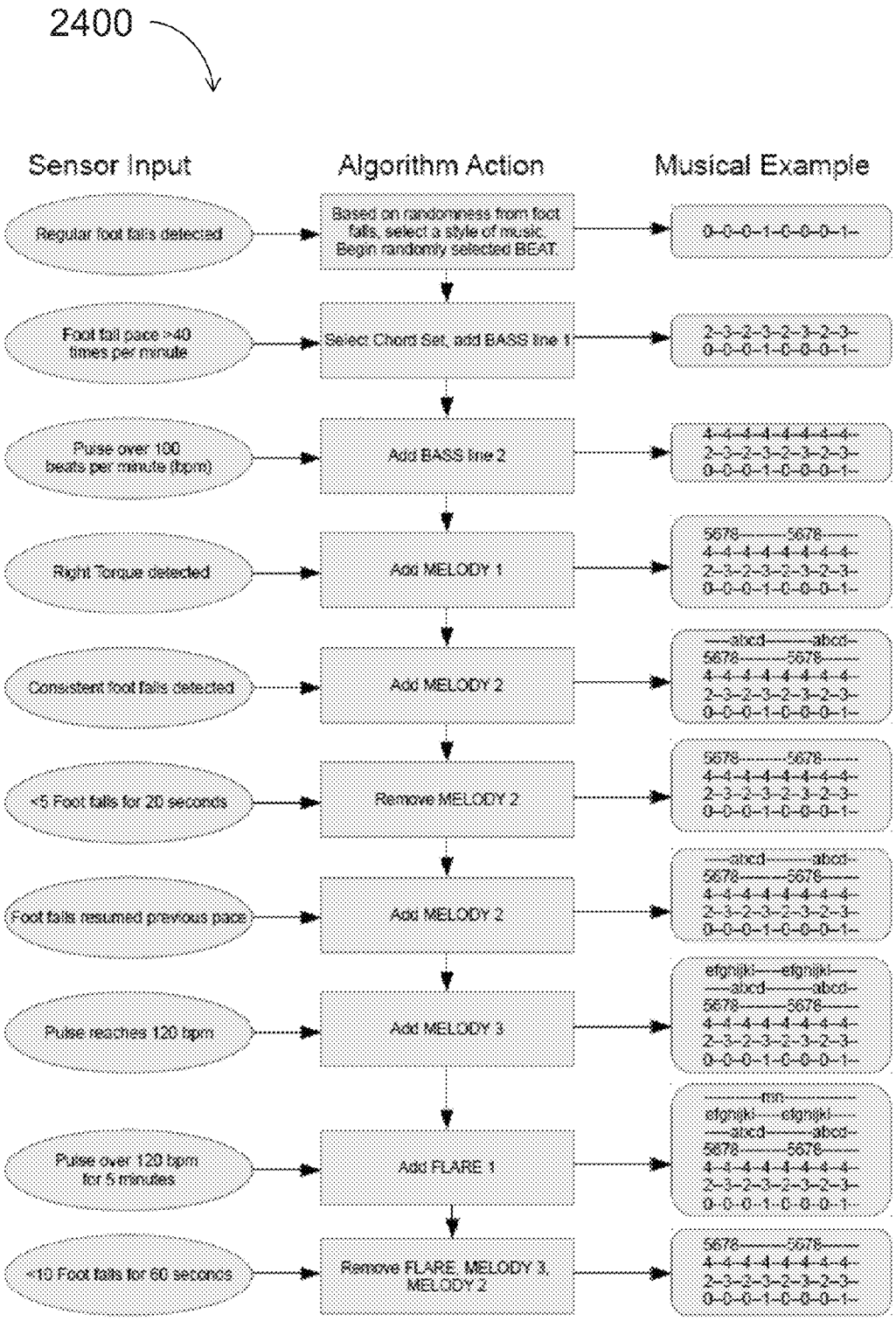
FIG. 24 shows a process view of an algorithm for generating music.
Figure 25:
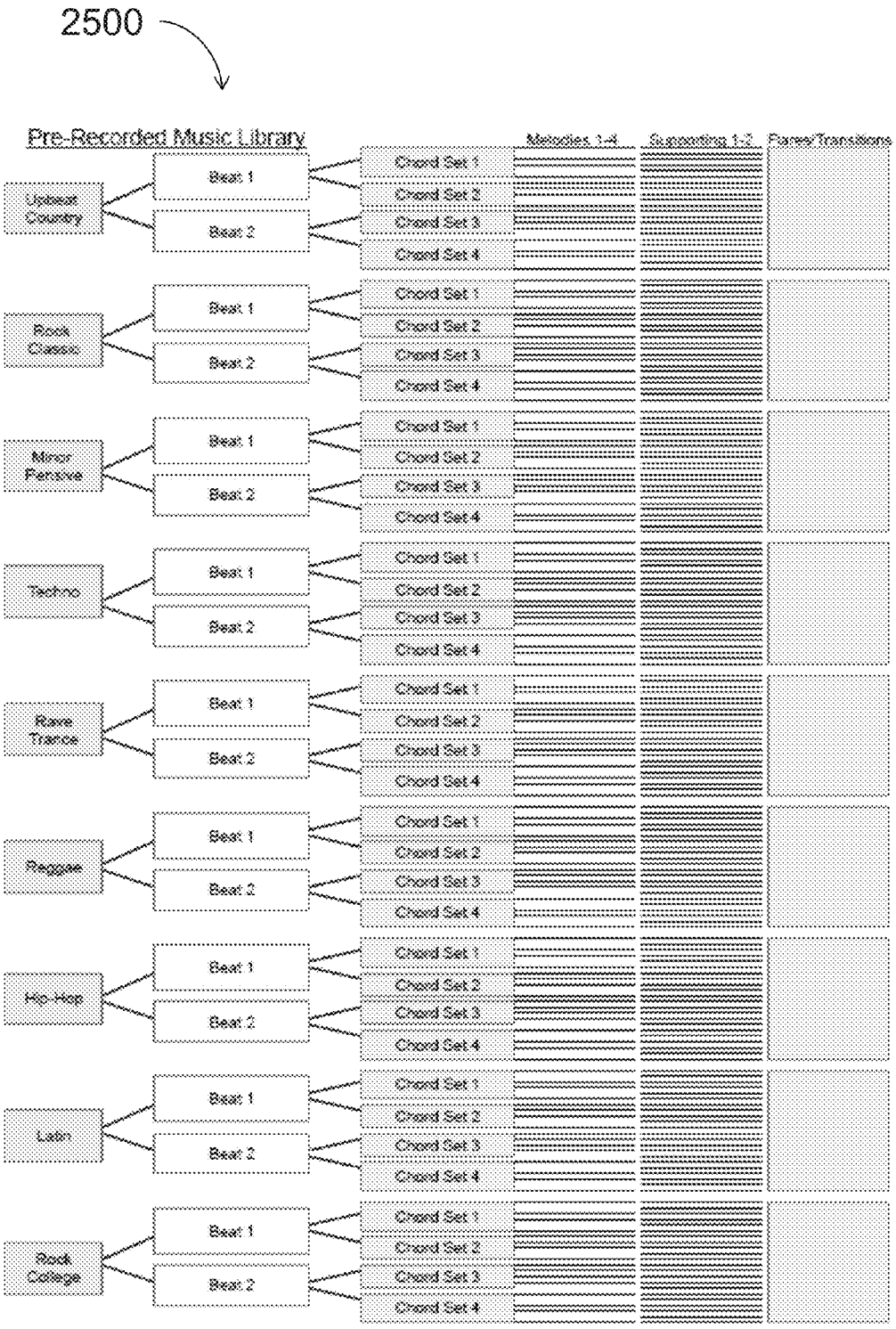
FIG. 25 shows a schematic view of a pre-recorded music library.

After analysis of the parameters relating to exercise, the components 1807 are capable of providing cues back to the wearer through any of the embodiments disclosed herein to encourage actions such as, but not limited to, warming up at the start of exercise, cooling down after exercise, setting a pace for the exercise, encouraging the wearer to change their pace, encouraging high intensity interval training (HIIT), encouraging sprint interval training (SIT), encouraging the Tabata method, or a combination thereof. The cues include sounds such as pre-recorded music, algorithmically generated sounds, or a combination thereof. For example, as illustrated in FIGS. 24-25, an algorithm 2400 (FIG. 24) may generate different music and/or sounds from a pre-recorded music library 2500 (FIG. 25 in response to parameters such as foot falls, pulse, and/or torque. In one embodiment, the sounds include tracks created with varying tempos, dynamics, timbre, intervals, scales, content and/or other sound/musical characteristics to communicate exercise related information to the wearer (i.e. HIIT, SIT). For example, in one embodiment, the cues include algorithmically generated or pre-recorded sounds and/or music that direct the wearer through carefully timed periods of rest mixed with intense physical exertion, such as HIIT.

In one embodiment, one or more of the components 1807 is configured to algorithmically generate a soundscape. As the wearer exerts his or her self, the soundscape is altered, such as, but not limited to, becoming more interesting, positive, or triumphant. For example, after the wearer starts running, the invention may start playing the sound of crickets. If the wearer continues running, or the wearer's running increases in intensity, other sounds may be added to the soundscape. Other sounds may include birds, children laughing, horses trotting, or any other suitable sound.

In another embodiment, the components 1807 algorithmically generate music and/or sounds that increase in intensity, interest, tempo, and/or dynamic qualities as the wearer continues an exercise program or episode of exercise. The algorithmically generated music and/or sounds may eventually build to a climax, crescendo, or plateau, such as is characteristic in, but not limited to, jam band music, music that builds slowly over time, or symphonies.

One or more of the components 1807 may use three dimensional (3D) sound points and sound positioning to give the wearer the sense that he or she is passing individual points where sounds emanate as he or she continues running The 3D sound points may be related to real world locations or coordinates. In another embodiment, if the wearer slacks off or stops, sounds drop off, eventually back to the point where only one sound is heard again. When the wearer starts moving again, the emanation points in the soundscape are gradually increased, as before. In another embodiment, the soundscape eventually leads to a predetermined climax as the exercise program is completed.

In another embodiment, sound samples may be algorithmically generated and/or modified and played to simulate that the wearer is moving through a three dimensional soundscape. In one example, a sound is repeatedly played while being panned from one channel (side) to the other. The panning simulates the effect of coming up on the emanation point of the sound in the distance, then passing it on one side or the other, then hearing it grow further and further away in the distance. The process of panning the sound over time takes into account the level at which the wearer is exercising and/or the speed at which the wearer is moving. In another example, the dynamic qualities or volume of the sound sample are changed. Changing the dynamic qualities or volume of the sound sample adds to the perception that the wearer has become closer to the sound's emanation point as he or she approaches, then further away again as the point recedes into the distance behind the wearer. The generation and/or modification of the sound samples takes into account the wearer's current speed and/or level of exertion.

In one embodiment, a Doppler Effect is simulated by algorithmically altering the sound samples as they are played. Compressing the wave/frequency of the sample as the wearer "approaches" it, then decompressing/expanding the wave/frequency as the wearer "moves away" from it, adds to the perception that the wearer is moving past sources of sound in three dimensional spaces. The altering of the sound samples may take into account the wearer's current speed and/or level of exertion, GPS positioning, or any other sensor input.

In another example, the cues are provided as an interactive theatrical experience generated through any of the embodiments disclosed herein. The interactive theatrical experience may include algorithmically generated sounds and/or music from the audio control unit 1310 or other components 1807 to create the sense that someone is chasing the wearer (i.e. zombies, enemies). The sense of being chased is configured to form a feeling of positive stress in the wearer such that when the integrated sensors detect that the wearer's activity level has increased or decreased the algorithmically generated and/or replayed sounds of pursuers respectively fade into the distance or increase in volume, frequency, and/or intensity. In another example, the components 1807 algorithmically generate sound and/or music to create a sensation of running through brush or water at speeds corresponding to the rate at which the wearer is traveling, as determined by the integrated sensors 1803. The feeling of positive stress or an emotional effect created by the theatrical experience encourages the wearer to maintain or increase their level of physical activity.

In another embodiment, when the wearer is in a predetermined location, as detected by the movement sensors, pre-recorded educational materials may be delivered through the audio delivery device 453. The pre-recorded education materials are either provided from the components 1807 or an external device, such as a smartphone. The educational materials may be played when the wearer is in proximity to their associated locations. Some of the educational material may be dynamically assigned to real world locations that the wearer frequents, perhaps during exercise activities. The assigning of the real world locations may be done in a random fashion by one or more of the components 1807. It may also be done by an external server or external device, such as a smart phone.

In another embodiment, the assigning of the educational material to locations may be done based on how often the wearer frequents that location, how much activity or intensity of activity the wearer engages in at that location, and/or the amount or intensity of activity the wearer engages in to get to that location. Once educational materials have been associated with real world locations, those educational materials may only be played when the wearer is near the relevant real world location. Some educational materials may only be unlocked when the wearer has reached particular pre-defined goals, adopted particular habits, or exhibited particular behaviors. Some educational materials may only be played (unlocked) after other particular materials have been played. The educational material is provided for any suitable purpose, such as, but not limited to, associating learning with real world locations to engage more areas of the brain as information is absorbed (i.e., to help the information "stick" better), providing a guided tour in a museum, an outdoor park, or similar attraction, or a combination thereof.

In one embodiment, the sensors 1803 include electrodes and the integrated hardware 1801 includes an electroencephalography (EEG) device, the accelerometer, a pulse sensor, an oxygen sensor, and/or a thermometer. Together the sensors 1803 and the integrated hardware 1801 determine and/or store parameters relating to mental state, such as brainwave patterns of the wearer. For example, the hardware 1801 may include the EEG device which is coupled to a conversion device that converts the EEG signal into a signal (i.e. A2DP) capable of being read by another device (i.e. computer, smart phone). In another embodiment, the sensors 1803 are integral with, or coupled to, the audio control unit 1310. The sensors 1803 are capable of collecting information such as, but not limited to, entropy data, data from the accelerometer, EEG signals from the electrodes, temperature variations, brainwaves, or a combination thereof and effecting a change in the wearer in response to the collected information.

For example, in one embodiment, the EEG device detects brainwave frequency indicative of excessive rumination such as in obsessive compulsive disorder, grief, and variants of normal but undesirable thought processes and alters the sounds and/or music being played by the audio control unit 1310; introduces or removes background sounds generated by the components 1807; increases or decrease volume; activates an alarm to break the wearer's cycle of rumination; notifies the wearer of the rumination; plays guided imagery or otherwise distracts the wearer from the rumination; or a combination thereof. In a further embodiment, the EEG device activates other modules described in further detail below to provide distractions or notifications such as lights, electrical stimulation, vibration, contraction of the headwear 100, or other stimulations. Breaking the wearer's cycle of rumination increases healthier sleep patterns, reduces the wearer's anxiety, increases the wearer's ability to break damaging habits, increases the wearer's ability to establish healthier habits, or a combination thereof.

In another example, the EEG device detects when the wearer enters REM sleep or a state of suggestibility. When the EEG device detects REM sleep the electronic device 450 generates stimulation such as, but not limited to, sounds, lights, electrical stimulation, vibration, or other indications designed to induce a lucid dreaming session. When the EEG device detects a state of suggestibility it may activate the audio control unit 1310 to play suitable sounds such as, but not limited to, pre-recorded messages of affirmation, learning material, or a combination thereof. In yet another example, the hardware 1801 may include an education module configured to play pre-recorded educational material when the wearer is determined to be in a stage of sleep considered conducive to sleep learning.

In a further embodiment, the EEG device may match the frequency of the wearer's brainwaves through frequency following response (FFR) evoked by precisely calibrated binaural beats. Matching the frequency of the wearer's brainwaves through FFR increases the similarity between the wearer's brainwaves and the binaural beats algorithmically generated by the components 1807. Additionally, increasing the similarity between the wearer's brainwaves and the binaural beats may increase the likelihood that the wearer will respond to changes in the frequency targeted by the binaural beats played through the audio delivery device 453. After matching the frequency of the wearer's brainwaves, a gradual change in the frequency of the binaural beats eases the wearer's brainwaves into any suitable range. Suitable ranges include, but are not limited to, characteristics of deep sleep, states of concentration or flow, or states of suggestibility.

In another embodiment, a carefully designed pre-recorded or algorithmically generated sound may be played to encourage the wearer to enter "flow state", or a state of intense concentration while engaged in a particular task.

In one embodiment, sounds, custom messages, lights, and/or other sensations may be delivered to alternating areas or sides of the wearer's body for entertainment purposes as well as therapeutic uses and/or evoking neurological effect, such as eye movement desensitization and reprocessing (EMDR) therapy. The sounds can be designed or recorded with the stereo effects in mind. In another embodiment, the sounds and/or other sensations are controlled and/or alternated by a predetermined or dynamically generated program. Inaudible pulses sent to the components 1807 by the audio control unit 1310 or the external device may control when and on which side or area of the body sounds and/or sensations are delivered. The sensations and/or stimuli include, but are not limited to, lights, vibrations, pulses, or electrical impulses. In one embodiment, sounds, music, tracks, messages, affirmations, whether pre-recorded, dynamically generated, or recorded by the wearer, may be played back in one channel at a time or primarily in one channel at a time. The sounds may be played completely or primarily in the left ear/speaker or the right ear/speaker. The side the sounds are played in may alternate one after the other, or in some predetermined or dynamically generated sequence, in order to achieve some therapeutic or entertaining effect.

In one embodiment, sounds or signals cue physical sensations as delivered by vibrators, relays, the lights 703, LEDs, motors, electrical stimuli or other electrical devices to be delivered by the device to specific areas or sides of the wearer's body. The sounds/signals making up these cues may be audible or inaudible pulses. The cues may be included in the sounds sent to the components 1807 by the audio control unit 1310 or by an external smartphone, sound player, computer, and/or other device. The cues may be dynamically generated or pre-recorded. The cues may be generated in response to readings taken by sensors on the invention. Such cues may stimulate the Autonomous Sensory Meridian Response (ASMR), EMDR, etc.

In another embodiment, playback is stopped when an inaudible audio pulse is embedded in sounds played by the audio control unit 1310 or by an external player, such as a smartphone or other device. The pulses are "heard" by one or more of the components 1807 and certain electronic controls can be activated, such as off, next track, or volume up. Playback may also be stopped at specific points by an application running on an external device. Playback may stop at a pre-determined point in a track or at a point that is determined dynamically. Playback may resume when the wearer presses a button built into the present invention. An external player may be informed of such a button press by an audible or inaudible pulse sent by the components 1807 and/or the audio delivery system 453, perhaps through the microphone input of the external device. In a further embodiment, the pulses are embedded in tracks or sound programs that are meant to pause while the wearer/user is meant to fall asleep, ponder a question, to respond to a verbal prompt, to repeat an affirmation, or any other suitable track or sound program. For example, the pulse may be embedded in sound programs designed to aid in CBT (Cognitive Behavioral Therapy), educational activities, guided imagery exercises, exercises designed to help the wearer/user to reprocess traumatic events, and the like. The pulses may also be used to determine whether the wearer is still listening, and therefore whether to pause or continue a program or audio presentation.

Other integrated sensors 1803 include, but are not limited to, an electronic compass, a gyroscope, the accelerometer, or a combination thereof configured to determine and or store metrics relating to an orientation of the wearer's body and how it changes over time. These metrics provide parameters relating to the wearer during various activities, particularly during sleep. In one embodiment, the components 1807 analyze the parameters relating to sleep and provides cues back to the wearer through any of the embodiments disclosed herein. The cues may encourage different transitions, behaviors, or other effects in the wearer. Suitable cues include, but are not limited to, electrical stimulation, sounds, music, playback of recorded affirmations, changes to the sounds and/or music currently playing, vibration, contraction of the band, lights, or a combination thereof. In another embodiment, the cues indicate to the wearer that they are in rapid eye movement (REM) sleep in an attempt to begin a session of lucid dreaming, induce dreams, induce nightmares, and/or attempt to bring the wearer into a deeper or lighter stage of sleep. In a further embodiment, in response to the stage of sleep, the components 1807 provide beats that match the wearer's current brainwave frequency to increase the likelihood that subsequent frequency changes to the music create a frequency following response in the wearer, and to encourage transitions from one stage to another.

In one embodiment, the components 1807 include a hall effect sensor and magnet, magnetic odometer, speedometer, or accelerometer wired or wirelessly coupled thereto. In another embodiment, the hall effect sensor is attached to any suitable piece of exercise equipment to measure the intensity and duration of the wearer's exercise. In a further embodiment, the metrics collected by these elements are used in the manners described above for any of the other sensors 1803 designed to collect metrics describing the user's physiological state, mental state, or physical exertion.

In response to parameters determined and/or stored by the integrated sensors 1803, the components 1807 are further able to provide combinations of sounds, lights, and/or sensations through any suitable process considered herein. For example, the components 1807 of the various embodiments disclosed herein are capable of producing at least sounds, lights, and/or sensations rhythmically, randomly, and/or at different intervals through methods such as, but not limited to, digital, analog, mechanical, physical, aural, or a combination thereof. The sounds, lights, and/or sensations are coordinated through the components 1807, any other suitable device, or combination of devices to affect a physiology or mental state of the wearer. In one example, the sounds, lights, and sensations, alone or in combination, distract the wearer from undesirable conditions (i.e. anxiety, tinnitus), signal the wearer in particular circumstances, create new habits in the wearer, and/or break existing undesirable habits of the wearer (i.e. tossing and turning during sleep). Signals to the wearer include, but are not limited to, the presence of an activated alarm; the wearer's vital signs as obtained by any of the sensors disclosed herein crossing a threshold; the wearer entering a particular stage of sleep; or a combination thereof. In another example, at pre-determined intervals one or more of the components 1807 inject pre-recorded messages, such as affirmations, into the music and/or sound currently being played to modify the wearer's behavior. The pre-determined intervals may be varied over time to increase their effect and/or build a specific habit.

The integrated sensors 1803 may also include electrodes. In one embodiment, one or more of the components 1807 associated with the electrodes silently signal the user, such as, but not limited to, at designated times for events, or alarms. For example, in one embodiment, the electrodes provide the wearer with gentle electrical stimulation, shocks, or haptic feedback. The silent signals may alert the user to proximity to danger, lost items, vehicles, or physical locations.

In one embodiment, a sleep module is configured to help train, encourage, and/or maintain an alternative sleep schedule. The sleep module may be integral with the microprocessor 451 and/or the audio control unit 1310, or combined with another module disclosed herein. Alternatively, the hardware 1801 may include the sleep module, forming a standalone sleep module which may be coupled to one or more of the other components 1807. The sleep module may also be included in an independent device via a software application. The alternative sleep schedules include, but are not limited to, various forms of polyphasic sleep. The sleep module configured to train the wearer to engage in an alternative sleep schedule may provide cues to the wearer when it is time to begin or end a sleep period. The cues may be in the form of sounds, music, lights, vibration, or other stimuli provided by components of the invention. For example, restful sounds and/or music may play during each sleep period, while more energetic sounds may play during waking periods. Warning sounds may play a few moments ahead of the switch from waking to sleeping, and vice versa. The lights 703 in the headwear 100 may shine over the eyes during waking periods, but switch off during sleep periods. In another embodiment, the lights 703 may include LEDs that shine bright blue or white light on the eyes during waking periods, then dim to darkness or dark red light during sleep periods. Higher wavelengths of light such as blue lights have been shown to suppress melatonin production, inhibiting sleepiness. The schedules for wake and sleep periods may change over time, as part of the process of adopting specific alternative sleep schedules involves slowly modifying your sleeping patterns over time.

In one embodiment, one or more of the components 1807 are configured to play a first sound in one stereo channel (one side), followed by a second sound in the other (on the other side). In another embodiment, the two sounds may or may not follow a question. The wearer then tilts his or her head to the side to select one of the two sounds, the accelerometer detecting which direction the wearer's head has been turned or tilted. Depending on whether or not the sound selected by the wearer was correct, positive or negative feedback is provided to the wearer. Score may be kept by the components 1807, by an external device, such as a smartphone, by a remote server, or any other suitable device. The educational content may be provided in any suitable format, such as a quiz, or a game.

In one embodiment, the electronic device 450 creates habits for the wearer with feedback and/or stimulation based on the parameters collected through the sensors 1803 and/or devices disclosed herein. In another embodiment, the parameters from a plurality of different wearer's are merged together to develop general information. The general information includes, but is not limited to, communal sleep patterns, algorithmically generated sounds and/or music with input from many wearers, or a combination thereof. In one example, data describing multiple wearers is aggregated to the server and compiled to create the algorithmically generated sounds and/or music with input from many wearers and stored on the server or transmitted to the electronic device 450 for playback. In a further embodiment, a plurality of wearer's rate the algorithmically generated sounds and/or music with input from many wearers and/or individual wearer's generated sounds and/or music based upon categories such as, but not limited to, purpose, effectiveness, pleasing effect, or a combination thereof.

In a further embodiment, collected data is merged together to create a social experience. For example, metrics or data points describing the wearers' movements, times of button activation, vital signs, environmental sounds, or other parameters are collected and sent to a central server. The aggregate results of the community's data are combined to form any suitable product, such as, but not limited to, a new track, an image, a video, a light program, a sound program, a vibration program, or a combination thereof. The product may be delivered to the community via a website, smartphone or other application, or by the invention itself. In another embodiment, measuring sleep and/or exercise patterns of a group or segment of a population provides an effective barometer (measure) of the mental health, physical activity, or other states of any individual group.

In one embodiment, an external display 707 (see FIG. 7) and/or the external lights 705 may be included to communicate to others. The external display 707 includes, but is not limited to, e-paper, an LCD, or LEDs. The external display 707 may be inserted into the headwear 100, attached to the outside of the headwear 100, placed in pockets on the headwear 100, sewn to the headwear 100, attached to the headwear 100 with hook and loop fasteners, otherwise secured to the inside and/or outside of the headwear 100, or a combination thereof. In another embodiment, the external display 707 permits the wearer to share information to others.

The information includes, but is not limited to, the wearer's physical and/or mental state, what sort (i.e., level) of recent or historical activity the wearer has engaged in, or where the user has been. The external display 707 may also show how long an exercise period the wearer plans to engage in, what levels the wearer is hoping to reach, or other exercise related information. Using the information gathered by one or more of the integrated sensors disclosed herein, the external display 707 may show blood sugar levels, pulse oximetry, pulse rate, temperature, brain wave activity, or other health related metrics. In another embodiment, the external display 707 shows others if the wearer is in distress, which may assist medical personnel, personal trainers, exercise buddies, or any other individual in close proximity. In one embodiment, the external display 707 shows others the wearer's physical state with video game-style graphics, perhaps as if a video game player was injured or had extra health points. The external display 707 may also be used to share the wearer's interests with others. For example, the external display 707 may show words, images, and/or symbols that show others a specific interest, characteristic, or condition that the wearer has chosen. The external display 707 may be used to share the wearer's disposition toward others, the wearer's state of arousal, the mood of the wearer (as determined by integrated sensors or other input device), the wearer's current progress in a video game, the wearer's adherence to an exercise program, or any other suitable information.

In another embodiment, when two wearers with similar interests come into proximity, the devices may detect each other and inform the wearers of each other. The wearer may be informed by sounds played by the audio control unit, lights, vibrations, electrical stimuli, or other stimuli. Others around the wearer may also be informed by external display 707*s* or the lights 703 integrated into the headwear 100. Lists of interests may be stored within the device's memory, on a remote server, or in an external device, such as a smartphone. The lists may be entered into an application running on a smartphone, a desktop, web page, or by other means, then transferred into any of the above places for storage. The devices would continually compare these lists of interests with those worn by other, nearby users.

In one embodiment, one or more of the integrated sensors 1803 and associated components 1807 disclosed herein may record the wearer's activity throughout the day and/or night. The recorded information may be stored, then later uploaded to an external device, server, smartphone, and/or computer. Activity recorded may include acceleration, location changes, and/or motion as recorded by an accelerometer and/or GPS, heart rate levels, sweat generated by exercise, electrical brainwave activity, or any other suitable activity. The stored information may be applied later by the components 1807 when the user interacts with a video game or other computer activity. In a further embodiment, the wearer's activities may have in-game effects. For example, the user may have more stamina, speed, power-ups, or other advantages or disadvantages in a video game if he or she has performed in an advantageous or disadvantageous manner throughout the day as determined by the sensors 1803 and associated components 1807 disclosed herein. In another example, if a group of children were very physically active throughout the day, running around, playing tag, kicking a ball around, participating in beneficial, aerobic activity, their online soccer team might have more power, speed, stamina, unlocked levels, unlocked resources into accounts paid by their parents, general effectiveness, or other benefits as informed by the components 1807 when they next play the video game. Beneficial physical activity during the day may also result in other virtual benefits.

In one embodiment, pre-recorded audiobooks, audio programs, lights, sounds, vibrations, haptic feedback, or stimuli programs are played either by the components 1807, sound recordings, or by an external device. Each of the programs may be broken up into parts or segments. The segments may then be played in either a predetermined or randomized order, and may or may not be repeated at pre-programmed intervals. The particular segment that is played may also be pre-programmed. The segments may be played based on the physical activity or physical state of the wearer, as determined by one or more of the integrated sensors 1803 disclosed herein, such as, but not limited to, accelerometers, GPS, sensors to measure pulse rate, pulse oximetry, brainwave activity, or galvanic skin responses. The segments are individually played over time as the wearer engages in desirable behavior. Some of the segments may not be revealed until the wearer has engaged in a certain amount of exertion within a certain period of time. For example, in one embodiment, to hear and/or experience an entire story, the wearer would need to exercise for a predetermined amount of time per session, exercise a certain amount over time, or reach particular exercise goals.

In another embodiment, scenes used in the segments of the story may be associated with real world locations, as determined by the movement sensors. The segments that include the scenes associated with real world locations would only be played when the wearer is in proximity to their associated locations. Some of the scenes used in and/or described by the segments may be dynamically assigned to real world locations that the wearer frequents, perhaps during exercise activities. In one embodiment, the assigning of the segments is done in a random fashion by the components 1807. In another embodiment, the assigning of the segments is done by an external server or external device, such as a smart phone. In a further embodiment, the assigning of the scenes from the story may be done based on how often the wearer frequents a particular location, how much activity or intensity of activity the wearer engages in at the particular location, and/or the amount or intensity of activity the wearer engages in to get to the particular location. Once the scenes have been associated with real world locations, segments relating to those scenes may only be played when the wearer is near the relevant real world location. Parts of the story may only be unlocked when the wearer has reached particular pre-defined goals, adopted particular habits, or exhibited particular behaviors. Some of the segments may only be played (unlocked) after other particular segments have been played.

Unit Casing

In another embodiment, one or more of the coverings 1511 (see FIG. 15) form unit casings surrounding one or more of the components 1807. In a further embodiment, the unit casings are wired together, or in wireless communication with each other permitting the components 1807 within the unit casings to communicate with each other. The unit casing includes any suitable unit casing material having "softness" to reduce or eliminate discomfort to the wearer. Suitable unit casing materials include, but are not limited to, fabric, silicone, plastic, rubber, foam, other materials that deform when pressure is applied, other materials with similar "softness", or a combination thereof.

In one embodiment, the unit casing is shaped to provide an increased ability to locate and/or move the unit casing within the headwear 100. For example, in one embodiment, as illustrated in FIGS. 15 and 18, the unit casing includes tapered and/or beveled edges to provide an increased ability to move the unit casing within the headwear 100. In another example, the unit casing has either a rectangular or a lozenge shape. In another embodiment, an outside surface may have ridges or fabric material with pile, which acts to increase friction and/or grip to keep elements in place during and between uses. In another embodiment, the outside surface of the unit casing is coated with a unit casing coating material that reduces friction between the headwear 100 and the unit casing. Suitable materials for the unit casing coating material include, but are not limited to, fabric (e.g. satin), silicone, plastic, rubber, foam, other material which provides reduced friction (slickness), or a combination thereof. The reduced friction permits the unit casing to move within the headwear 100 during use, and/or be removed when desired. In another embodiment, the outside surface of the unit casing is covered with a fabric having a pile that does not grip the surrounding headwear 100.

In an alternate embodiment, one or more of the components 1807 are secured to a separate article other than the headwear 100, such as a necklace choker 1703 (see FIG. 17), a band, or any other article configured to be placed on or around the body. The separate article may be placed on or around any portion of the wearer's body, including, but not limited to, the upper arm, lower arm, wrist, leg, chest, directly to the wearer's ear, or a combination thereof. In one embodiment, the components 1807 and/or the integrated sensors 1803 in the separate article provide direct measurement to the body part around which the band is placed. For example, a band positioned on the wearer's ankle, thigh, or waist may provide direct measurement of the wearer's gait, footfalls, and/or general activity level. Additionally, a band positioned on the wearer's wrist may provide direct measurement of the wearer's activity level, pulse, pulse oximetry, and/or galvanic skin response; a band positioned around the wearer's neck, such as the necklace choker 1703, may provide direct measurement of respiration and/or eating habits; and a band positioned around the wearer's chest may provide direct measurement of respiration and/or heart rate. The direct measurement from the components 1807 and/or integrated sensors 1803 in the separate bands provides increased accuracy and/or quantity of measurements.

In another embodiment, the components 1807 and/or the integrated sensors 1803 in the separate article provide direct stimulation to the body part around which the band is placed. For example, a vibration to the wrist may provide a reminder for the wearer to increase arm motion. In addition, a light or shock from a band on one wrist may provide information specific to one side of the wearer's body. In a further embodiment, the components 1807 in bands worn near specific body parts, nerve clusters, or chakras may deliver therapeutic programs configured to provide specific effects. For example, the therapeutic programs may include delivering stimuli to alternating sides of the wearer's body to facilitate EMDR or any other therapy. The body part that the band is positioned around is selected based upon the measurement and/or stimulation provided by the components 1807 and/or integrated sensors 1803 within the band.

Temperature Control

Referring to FIG. 19, in one embodiment, the headwear 100, the hardware 1801, and/or the other components 1807 include one or more temperature modifying inserts 1905, such as, but not limited to, one or more heating elements, one or more Peltier junctions, one or more low profile fans, or a combination thereof. The temperature modifying inserts 1905 provide increased and/or decreased temperatures to the wearer's head when inserted into the headwear 100. In another embodiment, increasing and/or decreasing the temperature of the wearer's head may provide the wearer with a more comfortable sleep, relief from headaches, relief from muscle aches, relief from TMJ, or a combination thereof. In a further embodiment, the one or more temperature modifying inserts 1905 are controlled by one or more of the devices described herein. For example, when the integrated sensors 1803 detect that the wearer is involved in strenuous activity the components 1807 may activate the one or more low profile fans. In another example, when the integrated sensors 1803 detect that the wearer is transitioning between stages of sleep, one or more heating elements may be activated by any of the components 1807 described herein.

The temperature modifying insert provides increased and/or decreased temperatures based upon the temperature modifying insert or combination of inserts used. The one or more temperature modifying inserts 1905 are secured to either the inside, or the outside of the headwear 100 with any suitable securing means, such as, but not limited to, friction, compression, positioning within the headwear 100, positioning within a pocket on the headwear 100, sewing to the headwear 100, hook and loop fasteners, or a combination thereof. In another embodiment, positioning of the temperature modifying inserts 1905 is adjustable, permitting the wearer to apply increased and/or decreased temperatures to a desired area of the head.

For example, in one embodiment, the one or more temperature modifying inserts 1905 are cooling inserts which provide decreased temperatures by maintaining decreased temperature for an extended period of time, and/or generating decreased temperatures through physical manipulation, such as by bending and/or striking the cooling inserts. In another embodiment, the temperature modifying inserts 1905 are heating inserts which provides increased temperatures by maintaining increased temperatures for an extended period of time, and/or generating increased temperatures through physical manipulation, such as by bending and/or striking the heating inserts. In a further embodiment, the heating insert includes the Peltier junction, which transfers heat when current is applied thereto. Inserting one or more of the temperature modifying inserts 1905 into the headwear 100 permits the wearer to increase, decrease, and/or regulate the temperature of at least a portion of their head.

In one embodiment, the one or more heating or cooling elements are positioned in any suitable position such as, but not limited to, conductive material embedded in the fabric, inside the headwear 100, in a pocket on the headwear 100, sewn to the headwear 100, attached with hook and loop fasteners, attached with any other securing means, or a combination thereof. In another embodiment, the one or more heating elements are positioned to affect predetermined portions of the head including specific muscles. In another embodiment, the heating elements are adjustable by the wearer. The heating elements generate increased temperature through the use of an external power source such as a battery, or a connection to the audio control unit.

In one embodiment, the one or more Peltier junctions are inserted into the headwear 100, attached to the outside of the headwear 100, placed in pockets on the headwear 100, sewn to the headwear 100, attached to the headwear 100 with hook and loop fasteners, otherwise secured to the inside and/or outside of the headwear 100, or a combination thereof. In another embodiment, the orientation of the Peltier junctions is adjustable to provide either increased or decreased temperatures to the wearer's head. The Peltier junctions are positioned to affect predetermined areas of the head, positioned to affect specific muscles, adjustable by the wearer, or a combination thereof.

In one embodiment, the one or more low profile fans are inserted into the headwear 100, integrated within the headwear 100, secured to the headwear 100, or a combination thereof. The one or more low profile fans may provide temperature regulation of the wearer's head, mechanical noise to help the wearer sleep and/or block out or dampen outside noises, or a combination thereof. In another embodiment, the low profile fans are arranged to generate a sensation on the wearer's head, such as a distracting sensation to help people with conditions such as tinnitus, nervous conditions, or a combination thereof.

Fluids

As illustrated in FIG. 19, in one embodiment, the headwear 100 includes at least one channel or tube (tube 1907) for circulating any suitable substance such as, but not limited to, gases, particles, fluids, or a combination thereof. The tube 1907 is fully enclosed, partially enclosed, or open, and is either secured within the headwear 100 or to the outer surface of the headwear 100. In a further embodiment, a pump 1909 or induction device is coupled to the at least one tube 1907, the pump 1909 circulating the substance within the tube 1907. The pump 1909 or induction device is operated by one or more of the components 1807. The circulation of the substance within the tube 1907 provides the wearer with effects such as, but not limited to, temperature regulation, mechanical noise, mechanical sensation, a sensation of being near water, relief from tinnitus, relief from anxiety, a blocking of outside sounds (i.e. snoring, traffic noise), noises to lull the wearer to sleep (i.e. rhythmic patterns), or a combination thereof.

In another embodiment, the pump 1909 is coupled to the audio control unit 1310, to provide mechanical sensations corresponding to the audio output. In yet another embodiment, the pump 1909 is coupled to the EEG device to provide a distraction when the integrated sensors 1803 detect the wearer has a lapse in concentration.

Massage

Figure 23:
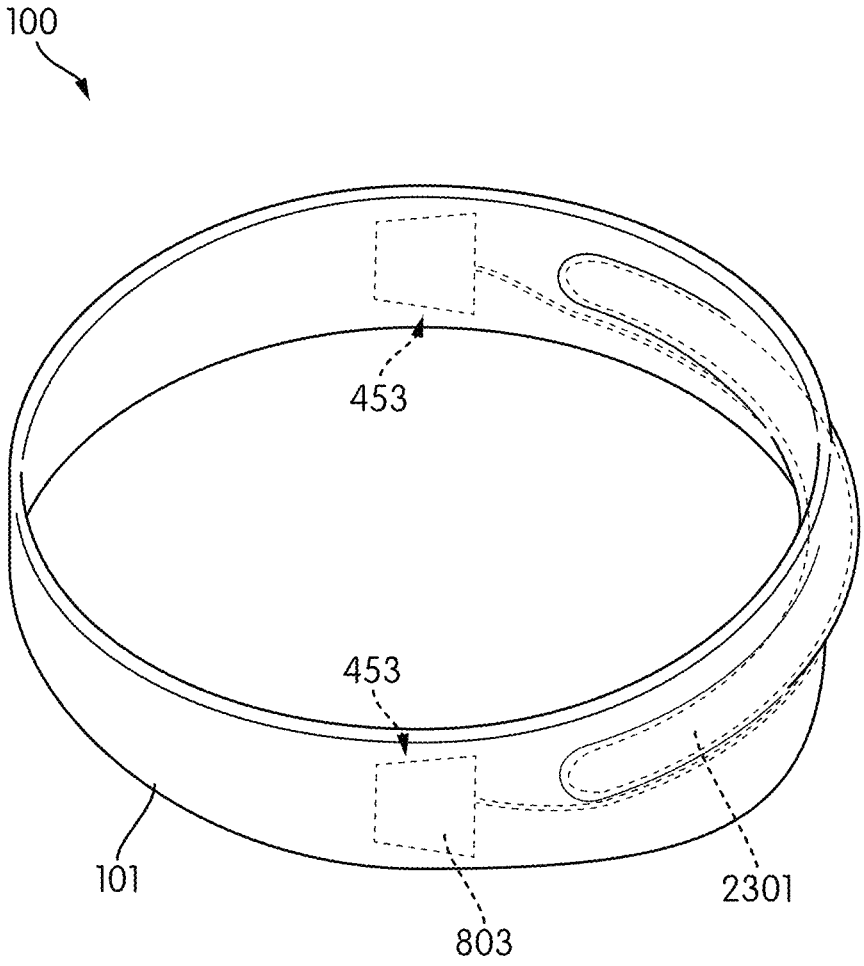
FIG. 23 shows a perspective view of an article of headwear including a massaging device.

Referring to FIG. 23, in one embodiment, the headwear 100 includes any suitable massaging device 2301. Suitable massaging devices include, but are not limited to, vibrating, contracting/relaxing, or a combination thereof. For example, in another embodiment, the contracting/relaxing massaging device includes a wire, such as a nitinol wire, incorporated into the headwear 100. The wire is configured to include expanding portions and contracting portions which produce a continuous back and forth massaging effect when current is applied. In another embodiment, the contracting/relaxing device includes any suitable means for producing the continuous back and forth massaging effect such as, but not limited to, gears, pulleys, cables, or a combination thereof.

The vibrating massage device is incorporated into the headwear 100 and integrated with one or more of the components 1807 or other features of the electronic device 450. For example, in one embodiment, the vibrating massage device is integrated with the accelerometer, such that the accelerometer provides a user interface for the vibrating massage device. In another example, the vibrating massage device is coupled to the audio control unit 1310 to form a vibration sensor sound module capable of coordinating the vibration from the vibrating massage device with the output from the audio control unit 1310, activating the audio control unit 1310 when vibration is detected, or a combination thereof.

Lights

In one embodiment, the lights 703, may include a reading light or flashlight integrated to the headwear 100. The reading light or flashlight may either be sewn into a frontal attachment or otherwise detachably affixed thereto. The lights 703 may be powered with the same power supply and battery as one or more of the components 1807, with the power module 1901, with a rechargeable battery, or with a removable, replaceable battery. In one embodiment, the lights 703 include, but are not limited to a light emitting diode (LED), incandescent lamp, fluorescent lamp, or other low-power-consumption technology. The lights 703 may be red, or amber, or some other color designed not to suppress the brain's production of melatonin or other normal sleep processes. The lights 703 having a predetermined color, such as amber, is necessary to avoid disturbing the sleep cycle, making the wearer and others more alert, and/or prevent the wearer from sleeping like white or blue light does. The selection of the predetermined color corresponds to a color that does not disrupt sleep and/or promotes sleep.

In another embodiment, the lights 703 and/or lasers powered by a built-in battery are attached to the headwear 100 either as a separate attachment or on the headwear 100 itself. The lights 703 shine on the wearer's face and/or body. The lights 703 may be used to provide additional light for cosmetic, safety, decorative, or fashion reasons. In one embodiment, a pattern of lights changes over time, for example, in either a preprogrammed or dynamically or algorithmically generated program. The program may change dynamically based on external stimuli (such as sounds in the wearer's proximity), metrics based on the wearer's activity, physiological state, or mental state. The lights 703 may change color, turn on and off, or change direction. In another embodiment, the lights 703 serve to foil cameras and/or facial recognition systems which may be observing the wearer.

The changes in lighting may be accompanied by sounds and/or music played by the audio delivery device 453, or by the additional speakers 807 that can be heard by others near the wearer. For example, a program may coordinate and/or dynamically generate the sound, the light, and/or other stimulus according to any of the modules or devices disclosed herein, based upon information such as, but not limited to, ambient sounds, ambient light, the wearer's biometrics, data from others, data from a server, or a combination thereof.

In one embodiment, the lights 1703 include LED's attached to the headwear 100 by any suitable attachment means. Suitable attachment means include, but are not limited to, affixed directly to the headwear 100 (e.g., sewn into the headwear 100), attached to the modules, or otherwise affixed to the headwear 100. In another embodiment, the LED's in the headwear 100 are short wave ultraviolet (UV-C) LED's designed to kill organisms such as dust mites which may affect sleep and allergies. A sensor or switch (sensor) may be built into the headwear 100 to trigger a light cycle after the wearer has removed the headwear 100. The sensor automatically deactivates the light cycle when it detects that the wearer has put on the headwear 100. In another embodiment, the light cycle may be a predetermined light cycle or may be switched on/off by the wearer when the headwear 100 is not in use. The sensor is any suitable sensor such as, but not limited to, a stretch sensor (see FIG. 26) designed to determine when the headwear 100 is in use. In an alternate embodiment, the LED's may also be oriented to kill undesirable organisms located in the area of the invention such as, but not limited to, the pillow, sheets, bedding, or a combination thereof.

In one embodiment, the LED's are incorporated into the detachable eye flaps 701 (see FIG. 7) and/or eye shades. In another embodiment, the LED's in the eye flaps 701 are activated during sleep to encourage lucid dreaming. In a further embodiment, the LED's interface with the accelerometer, and/or other sources of metrics to coordinate with sleep patterns, stages of sleep, or a combination thereof. In one embodiment, a light may be affixed to the headwear 100, such as by sewing, to allow others to more easily note the presence of the wearer.

While the invention has been described with reference to a preferred embodiment, it will be understood by those skilled in the art that various changes may be made and equivalents may be substituted for elements thereof without departing from the scope of the invention. In addition, many modifications may be made to adapt a particular situation or material to the teachings of the invention without departing from the essential scope thereof. Therefore, it is intended that the invention not be limited to the particular embodiment disclosed as the best mode contemplated for carrying out this invention, but that the invention will include all embodiments falling within the scope of the appended claims.

What is claimed is:

1. An article of headwear, comprising:

a material configured for surrounding at least a portion of an individual's head;

an audio delivery device movably positioned within the material, the audio delivery device being embedded in an enclosure comprising silicone; and a microprocessor positioned within the material, the microprocessor being coupled to the audio delivery device and enclosed by a flexible covering comprising a joint, the joint to mold the flexible covering around the natural curvature of the individual's head.

2. The article of claim 1, wherein the microprocessor includes an audio control unit.

3. The article of claim 1, wherein the microprocessor is flexible.

4. The article of claim 1, further comprising at least one sensor coupled to the microprocessor, wherein the microprocessor is configured to algorithmically generate sound in response to parameters received from the at least one sensor.

5. The article of claim 1, further comprising integrated hardware coupled to the microprocessor.

6. The article of claim 5, wherein the integrated hardware is selected from the group consisting of a receiving module, a sound layering module, a volume measuring module, a noise cancellation module, a background sound module, an accelerometer module, an electroencephalography (EEG) device, a pulse sensor, an oxygen sensor, a thermometer, an education module, a sleep module, and combinations thereof.

7. The article of claim 5, wherein the audio delivery device, the microprocessor, and the integrated hardware are removably positioned within the headwear.

8. The article of claim 1, wherein the material further comprises a first layer of material and a second layer of material.

9. The article of claim 8, wherein the first layer of material includes a first material and the second layer of material includes a second material, the first material being different from the second material.

10. The article of claim 8, wherein the first layer of material includes a first design and the second layer of material includes a second design, the first design being different from the second design.

11. The article of claim 1, wherein the article of headwear is selected from the group consisting of a headband, a hat, a visor, a winter cap, a beanie, a kerchief, sleep attire, active attire, and combinations thereof.

12. The article of claim 1, wherein the audio delivery device is selected from the group consisting of speakers, infra sound transducers, bone conduction devices, and combinations thereof.

13. The article of claim 12, wherein the audio delivery device is embedded in an enclosure, the enclosure containing one of the speakers and being removable from within the headwear.

14. The article of claim 13, wherein the enclosure includes a tapered portion, the tapered portion maintaining a position of the enclosure within the headwear.

15. The article of claim 13, wherein the enclosure includes a speaker wire channel, the speaker wire channel reducing tension at a connection point between one of the speakers and a speaker wire.

16. The article of claim 13, wherein the enclosure includes ridges on an outside surface.

17. The article of claim 1, further comprising at least one component selected from the group consisting of a temperature modifying insert, a channel arranged and disposed to circulate a substance, a massaging device, a light, and combinations thereof.

18. The article of claim 17, wherein the light is arranged and disposed to kill undesirable organisms.

19. The article of claim 1, further comprising a power module including a printed circuit board coil, the power module being arranged and disposed to provide wireless charging with an induction charger.

20. The article of claim 1, wherein the audio delivery device is embedded in a fabric enclosure.

21. The article of claim 20, wherein the audio delivery device comprises a surface facing toward a curvature of the head when equipped, the surface being entirely protected by the fabric enclosure.

22. The article of claim 1, wherein the flexible covering comprises silicon.

23. A method of generating sounds, the method comprising:

providing an article of headwear, the article of headwear comprising:

a material configured for surrounding at least a portion of an individual's head;

an audio delivery device movably positioned within the material; and a microprocessor positioned within the material, the microprocessor being coupled to the audio delivery device and enclosed by a flexible covering comprising a joint, the joint to mold the flexible covering around the natural curvature of the individual's head;

algorithmically generating sounds with the microprocessor; and playing the sounds through the audio delivery device.

24. The method of claim 23, wherein the sounds follow defined heuristics.

25. The method of claim 23, wherein the sounds are generated in response to parameters from integrated sensors coupled to the microprocessor.

26. The method of claim 25, further comprising analyzing the parameters and performing an operation in response to the analyzing of the parameters.

27. The method of claim 26, wherein the operation comprises modifying the sounds playing through the audio delivery device.

28. The method of claim 23, further comprising receiving information from a remote server, and algorithmically generating the sounds in response to the information.

29. The method of claim 23, wherein algorithmically generating sounds includes generating sounds selected from the group consisting of a soundscape, a Doppler Effect, a theatrical experience, and combinations thereof.

30. The method of claim 23, further comprising layering sounds with a sound layering module.

31. The method of claim 23, further comprising displaying wearer information on an external display secured to the headwear.

32. The method of claim 23, further comprising:

playing a first sound through a first side of the audio delivery device, and playing a second sound through a second side of the audio delivery device;

recording a wearer's movement in response to the playing of the first sound and the second sound; and generating feedback in response to the wearer's movement;

wherein the wearer's movement is recorded with an accelerometer.

33. A method of recording activity, the method comprising:

providing an article of headwear, the article of headwear comprising:

a material configured for surrounding at least a portion of an individual's head;

at least one sensor; and a microprocessor positioned within the material, the microprocessor being coupled to the at least one sensor and enclosed by a flexible covering comprising a joint, the joint to mold the flexible covering around the natural curvature of the individual's head;

determining a wearer's activity with the at least one sensor;

communicating the wearer's activity to the microprocessor; and storing the wearer's activity with the microprocessor as stored activity.

34. The method of claim 33, further comprising:

transmitting the stored activity to an external device; and applying the stored activity to a digital activity.

35. The method of claim 34, wherein the digital activity includes a video game.

36. The method of claim 35, wherein applying the stored activity to the video game includes adjusting in-game characteristics in response to the wearer's activity.

37. The method of claim 34, wherein the digital activity includes a recording.

38. The method of claim 37, wherein applying the stored activity to the recording includes incorporating the wearer's activity into the recording.

* * * * *